US005590497A

United States Patent [19]

Moore

[11] Patent Number: 5,590,497

[45] Date of Patent: Jan. 7, 1997

[54] CIRCULAR OR GENERALLY CIRCULAR PRESTRESSED CONCRETE TANK AND METHOD OF CONSTRUCTING SAME

[76] Inventor: Richard G. Moore, 3722 SW. 82nd St., Gainsville, Fla. 32608

[21] Appl. No.: 309,204

[22] Filed: Sep. 20, 1994

Related U.S. Application Data

[63] Continuation-in-part of Ser. No. 922,382, Jul. 31, 1992, abandoned.

[51] Int. Cl.[6] ..... F04H 7/20; E04G 21/14

[52] U.S. Cl. ..... 52/223.3; 52/223.7; 52/249; 52/745.1; 52/745.13; 52/745.2

[58] Field of Search ..... 52/223.2, 223.3, 52/223.7, 245, 249, 745.07, 745.08, 745.19, 745.2, 223.6, 745.05, 745.09, 745.1, 745.13

[56] References Cited

U.S. PATENT DOCUMENTS

| | | | |
|---|---|---|---|
| 2,319,105 | 5/1943 | Billner | 52/233.3 |
| 3,146,549 | 9/1964 | James | 52/233.3 |
| 3,280,525 | 10/1966 | Crowley | 52/223.3 |
| 3,385,016 | 5/1968 | Crom | 52/249 |
| 3,404,500 | 10/1968 | Akita et al. | 52/249 |
| 3,408,784 | 11/1968 | Crowley | 52/223.3 |
| 3,409,916 | 11/1968 | Billig et al. | 52/249 |
| 3,804,260 | 4/1974 | Crowley | 52/223.3 |
| 4,015,383 | 4/1977 | Crowley | 52/223.3 |

*Primary Examiner*—Michael Safavi
*Attorney, Agent, or Firm*—Julian C. Renfro, Esq.

[57] ABSTRACT

A tank of generally oval configuration created by the use of a plurality of curved, precast concrete panels of uniform size and rectangular configuration. Each panel is constructed utilizing a diaphragm liner either made of corrugated structural material or else of rubber-like material. The diaphragm liner of corrugated structural material possesses a degree of arcuate curvature, so as to be concave on one side and convex on the other. Both types of liners are intended to receive concrete poured to a desired depth on the convex surface of the liner, with the outer surface of the concrete then contoured to a finished condition to form the exterior surface of the tank made from the panels. One or more horizontally disposed ducts are installed in the concrete prior to hardening, placed in accordance with a consistent pattern. As a result, when a suitable number of precast panels are installed on a floor surface to form a generally oval configuration, it can be expected that each set of horizontally disposed ducts will reside in substantial alignment, and thus be in a position to receive an elongate tensioning member. After the precast panels have been drawn together, a suitable fastening arrangement is utilized to hold the precast concrete panels together to form a tank usable for a variety of purposes. This invention comprehends the novel method of making a tank as well as the construction of tanks of circular, elongate or elliptical configuration.

30 Claims, 16 Drawing Sheets

CIRCULAR OR GENERALLY CIRCULAR PRESTRESSED CONCRETE TANK AND METHOD OF CONSTRUCTING SAME

RELATIONSHIP TO PREVIOUS APPLICATION

This is to be regarded as a Continuation-in-Part of my patent application entitled "CIRCULAR PRESTRESSED CONCRETE TANK AND METHOD OF CONSTRUCTING SAME," Ser. No. 07/922,382, filed Jul. 31, 1992, which is to be abandoned with the filing of this application.

FIELD OF INVENTION

This invention relates to an improved prestressed concrete tank with walls composed of precast wall panels, which contain a diaphragm liner and internal horizontal ducts for containing the tensioning members utilized for holding the wall panels together.

DESCRIPTION OF PRIOR ART

It is known to construct a prestressed concrete tank with walls of precast panels. These tanks are constructed of prestressed concrete wall panels with a diaphragm liner on the outside face. The panels are spaced apart and are generally continuous over the full height of the tank, being positioned to form the tank wall. The closure strip between the panels has a diaphragm liner strip on the exterior face and is filled with concrete. The diaphragm liner located on the exterior face of the precast wall panel is covered with a coating of cementitious material which comprises the corewall. Over the corewall. prestressed steel is wrapped under tension. After the prestress steel application is completed, another cementitious layer is placed to permanently bond the prestressing steel to the tank corewall and protect the prestressing steel and diaphragm liner. This final cementitious layer is given the final exterior tank wall finish.

There are very definite drawbacks associated with the techniques of the prior art, one of which is the time involved in the prestressing operation, both in setting up the equipment and in tensioning the prestressing members. As is well known, there is ordinarily an intense requirement for skilled labor during the prestressing operation, which essentially is the tightening of the structural tensioning members, which provides the ring compression necessary to contain the contents of the tank.

Another drawback of the prior art is the large amount of time involved in the placement and finishing of the exterior cementitious coating over the prestressing members which forms the exterior finish tank wall surface. There is manifestly an intense requirement of skilled labor in the application of the cementitious material covering the prestressing members and in finishing the tank wall surface.

Still another disadvantage of prior art techniques involves the need for highly specialized equipment to accomplish the prestressing operation, and the highly specialized equipment needed for the final tank wall finishing.

Yet another disadvantage of the prior art techniques are the sensitivity that both the prestressing operation and exterior tank wall finishing operation have to cold and rainy weather.

Still other drawbacks involve the fact that the full wall thickness is not placed in compression; the entire wall thickness is not the corewall; and the exterior cementitious coating over the prestress members is placed after the prestress operation.

Yet other drawbacks involve the safety hazard of the prestressing steel breaking during the prestressing operation, and the problem of the cementitious coating over the prestressing members delaminating from the tank corewall.

Still other drawbacks involve quality control of the cementitious coating over the tank prestressing members, and the fact that the straightness vertically and true horizontal curvature are difficult to maintain on the finish wall surface when the cementitious layer is applied to form the finish wall surface.

Yet still another drawback involves the fact that when decorative pilasters are added, they are placed as an add-on to the finish wall and are not always permanently bonded to the tank wall, this often leads to spalling and delamination.

It is therefore one of the purposes of this invention to provide superior wall panels as well as a markedly improved method of constructing prestressed concrete tanks of several different embodiments, and of extremely high quality.

SUMMARY OF THE INVENTION

As will be seen in considerable detail hereinafter, this invention pertains to a novel and highly effective method for the construction of prestressed concrete tanks of a multiplicity of embodiments, and is directed to solving the above-mentioned problems associated with the prior art efforts to build prestressed concrete tanks. One objective of the invention is a tank with precast wall panels which contain a diaphragm, internal prestressing, and finish tank wall surface in one panel. The tensioning members, which are the circumferential members that provide the necessary hoop force to contain the contents of the tank and assure structural integrity of the tank, can be controlled in position to obtain the proper, measurable concrete cover. In this context, cover is a protective layer of concrete applied over tensioning member or reinforcing steel or diaphragm liner. The tensioning members can be positioned vertically on the wall in the exact location. Each tensioning member is further protected by using a respective impervious horizontal duct.

Improved quality of the exterior tank wall finish and structural integrity can be real i zed by fabricating the novel precast wall panels in a controlled environment, one which is not subject to objectionable temperature fluctuations or to rainy weather halting the construction or marring the finish. The cementitious coating over the tensioning members is made an integral part of the wall and therefore is not subject to delamination.

One important object of this invention involves tank construction wherein the corewall is the total wall thickness, which provides for economical use of materials. This eliminates the application of a cementitious coating over the tensioning members. In doing so less skilled labor is required, less time is required to construct the wall and less specialized equipment is required for construction. All of the wall is in compression from the tensioning of the tensioning members, and this reduces tensile cracking in the wall. Quite advantageously, the wall can be constructed straight vertically and to a selected overall configuration.

Another object of this invention is to provide a basic tank constructional technique readily lending itself to the creation of circular prestressed concrete tanks, as well as tanks that may be regarded as of generally circular or generally oval configuration.

Yet another object of this invention is the provision of a tank with precast wall panels with diaphragm liners where the panels are either curved horizontally to a uniform degree and arranged to create a generally cylindrical tank wall, or else created to have substantial curvature and then used with a series of panels having either no curvature or only slight curvature, so that tanks of generally oval configuration can be created, including tanks of generally elliptical configuration.

Still another object of this invention is the provision of a panel constructional technique enabling the creation of precast wall panels possessing curvature suitable for the construction of circular tanks, as well as panels possessing more substantial curvature, of the type needed in the construction of the ends of elongate tanks, with those substantially curved panels being used with a series of panels that are either substantially flat, or else panels having some curvature, that are used in the creation of the sides of generally elliptically shaped tanks.

Yet still another object of this invention is the provision of a tank with precast wall panels with diaphragm liners where a closure strip protrudes past the panel wall surface and creates a decorative vertical pilaster. This improves the appearance of the tank, giving relief to the wall. With the pilasters built in this manner, less skilled labor and less involved equipment is required and an added quality measure is achieved by creating them as an integral part of the wall.

Yet still another object of this invention involves a tank with precast wall panels with diaphragm liners where the precast wall panels have an embedded decorative finish in the surface. This gives a uniform decorative treatment on the finished tank wall surface and ensures that the decorative finish will be permanent, inasmuch as it is a part of the tank wall.

Yet still another object of this invention is the provision of a tank with precast wall panels with diaphragm liners where the horizontal ducts containing the tensioning members are filled with a rigid bonding filler, creating a permanent bond between the tensioning member and the tank corewall. The tensioning member is permanently anchored along the full length of the member and thus is protected against corrosion by the rigid bonding filler.

Yet still another object of this invention is the provision of a tank with precast wall panels and diaphragm liners where the horizontal ducts containing the tensioning members with the internal void filled with a non-rigid, corrosion-inhibiting filler, which filler prevents corrosion from attacking the tensioning member. When the corrosion-inhibiting filler with a lubricating property is used, the tension becomes more uniform in the tensioning member due to the reduction of friction between the tensioning member and the horizontal duct, The number of elongate tensioning members (stressing members) is reduced because the friction in the tensioning members is significantly eliminated. Inspection of each tensioning member at a future date is possible in accordance with this arrangement.

Another important object of my invention involves the novel method of constructing a prestressed concrete tank with precast wall panels where each wall panel contains the diaphragm liner, prestressing duct, and finish wall surface, and upon being erected, requires only the closure strip, tensioning menders and cementitious cover over the diaphragm to complete the tank wall. It is to be noted that less skilled labor is required to fabricate the precast wall panel under factory-type conditions. The finishing and application of the finish wall surface is net subject to temperature or rainy weather since the panels can be fabricated under a controlled, covered environment, This is particularly true with regard to the construction of tanks with roofs where the entire tank can be constructed in cold and rainy weather and the cementitious coating can be placed on the diaphragm liner after the roof has been constructed, The constructing of the panels requires less skilled labor, less specialized equipment, and reduces time in both manufacturing the panels and erecting the panels.

These and other objects, features and advantages will become more apparent as the description proceeds.

DETAILED DESCRIPTION

Figure 1:
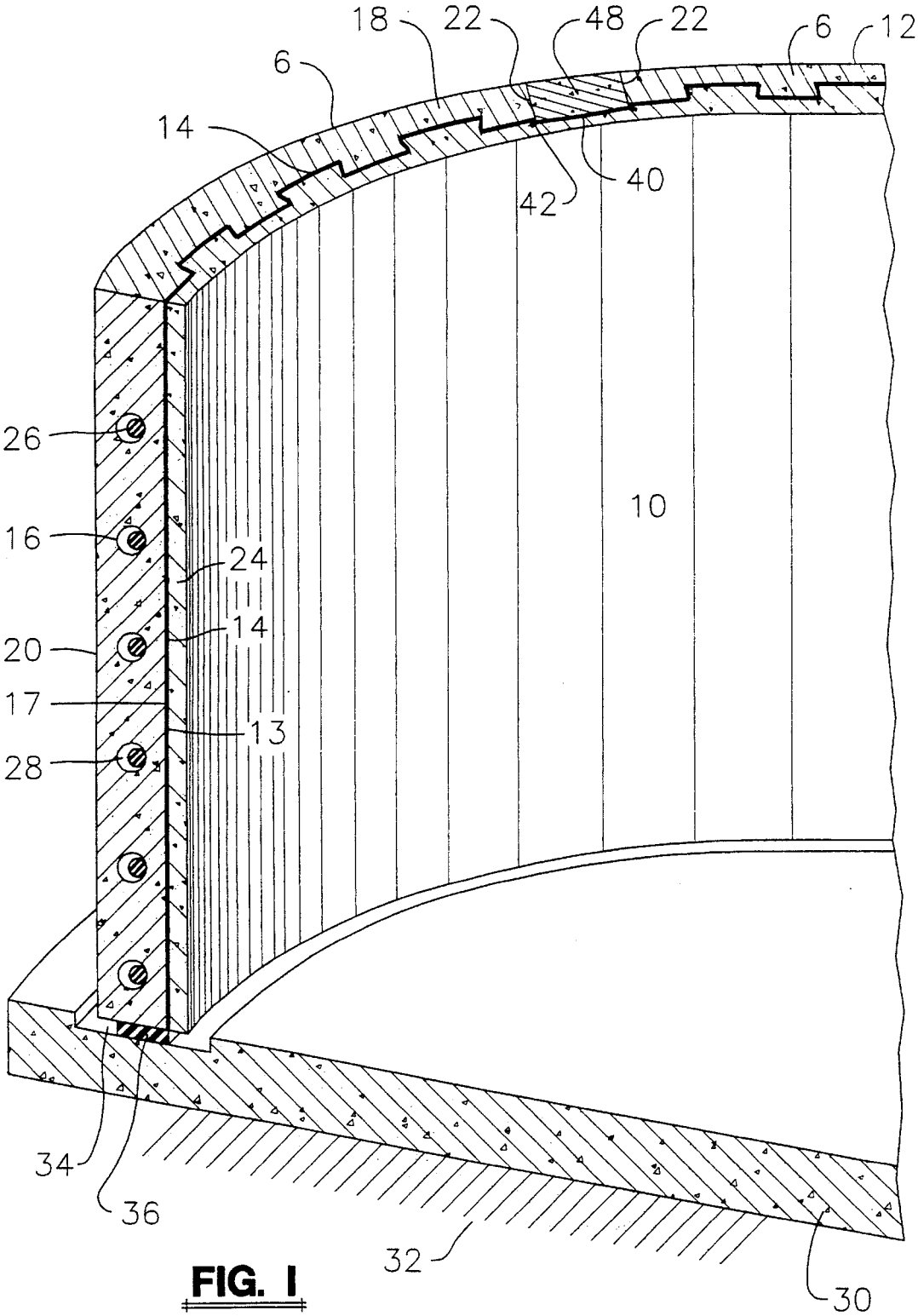
FIG. 1 is a perspective view of a section of prestressed concrete tank in accordance with a first embodiment of this invention, in this instance showing a pair of prestressed concrete panels in abutting relationship.

FIG. 1 shows a portion of a prestressed concrete tank 10 in accordance with a first embodiment of my invention, which tank is equipped with a curved outer wall 12 and a floor 30. As will be discussed at length hereinafter, the wall 12 is made up of a selected series of novel precast wall panels 6, which I may also refer to as precast concrete panels.

It is to be noted that the technique I utilize in the construction of these novel wall panels is usable in the creation of tanks of generally oval configuration, which includes tanks that are circular, generally circular, elliptical, generally elliptical, elongate, and the like. I am aware that some regard the word "oval" as meaning "egg shaped," but all of my tank embodiments are of symmetrical configuration, and none of the tank embodiments have one end larger than another, in the manner of an egg. The term "elongate" is used herein to connote a tank having substantially straight sides and curved ends.

It is to be noted that precast wall panels 6 depicted in FIG. 1 are or consistent curvature, making them ideal for use in the creation of tanks that are of circular configuration.

Figure 2:
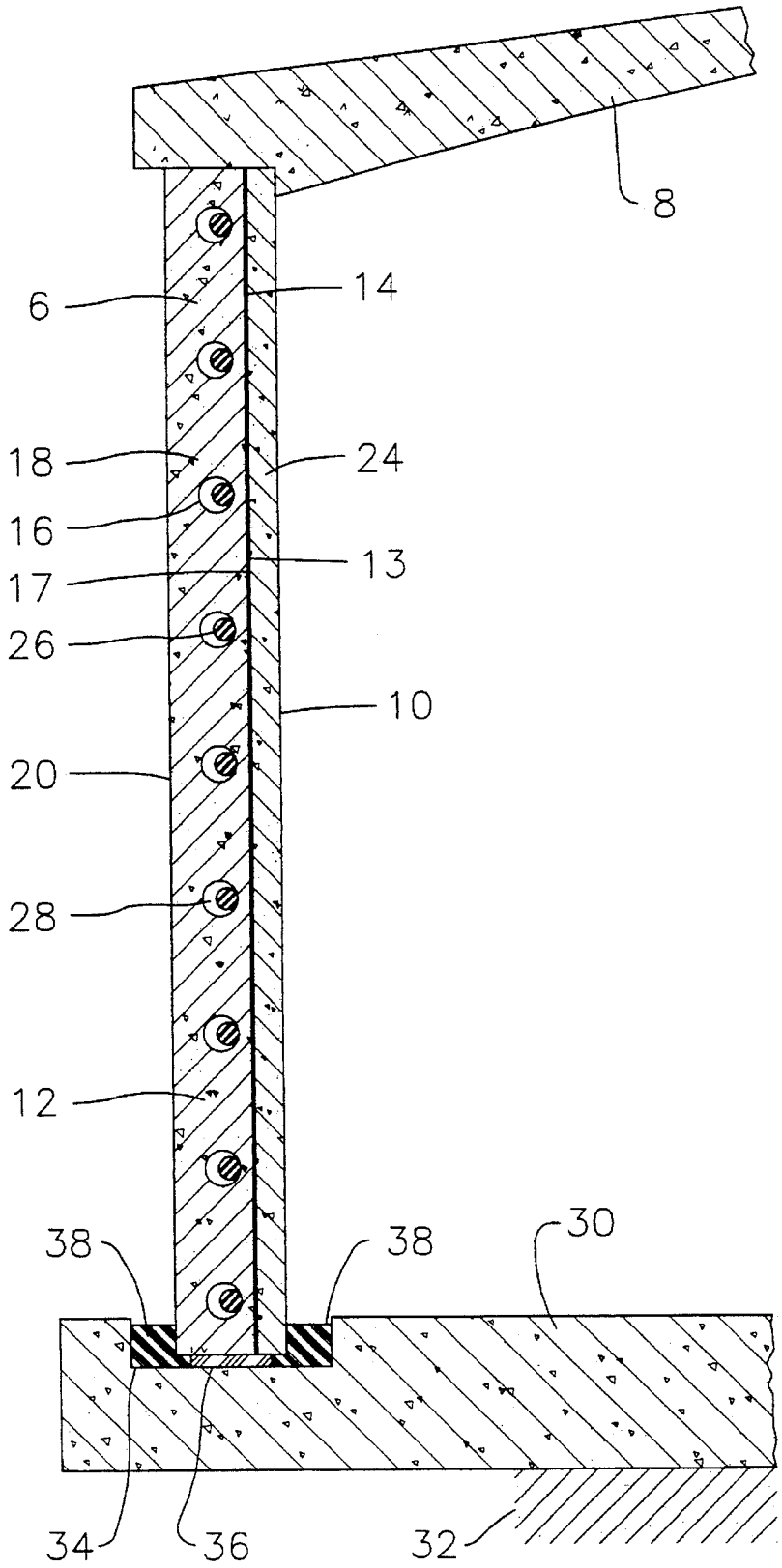
FIG. 2 is a sectional view of the prestressed concrete tank showing the tank wall and its interaction with the tank floor, and also revealing a section of a typical roof member.

Only a fragmentary portion of the roof 8 of the tank is shown in FIG. 2, but roofs for tanks of this type are well known in the industry and can be constructed in flat, domed, or other appropriate shapes. It is therefore to be understood that a suitable roof 8 can be incorporated into the prestressed tank in accordance with this invention, making it a covered vessel as will be seen hereinafter with other embodiments of this invention.

In FIG. 1, I have indicated a portion of a completed prestressed concrete wall 12 of a cylindrically shaped tank in accordance with this invention, with two of my novel precast wall panels 6 shown in abutting relationship. The precast wall panels 6 are joined on the adjacent, vertically extending ends by a closure strip which is made up in part by a concrete fill 48. The interior surface of the wall has an applied cementitious coating 24. The floor slab 30 of the tank is shown placed on a suitable subgrade 32, visible in FIG. 1 as well as in FIG. 2. The construction of floors 30, whether membrane, conventional, ballast, or structural, is of course well known in the industry.

It will be noted in this first embodiment of my invention depicted in FIGS. 1 and 2 that a floor groove 34 has been placed in the floor 30 to receive the bottom of each of the precast wall panels 6, and make a watertight connection between the completed wall 12 and floor 30 of the tank. To create a watertight seal between the floor 30 and the wall 12, I preferably utilize a suitable sealant 38 in the floor groove 34, such as polysulfide, epoxy or cement grout; note FIG. 2. Other methods of sealing the wall 12 to the floor 30 are well known in the industry and are easily adapted to this invention. As will be discussed hereinafter, I may utilize shims 36 placed under each wall panel.

Figure 3:
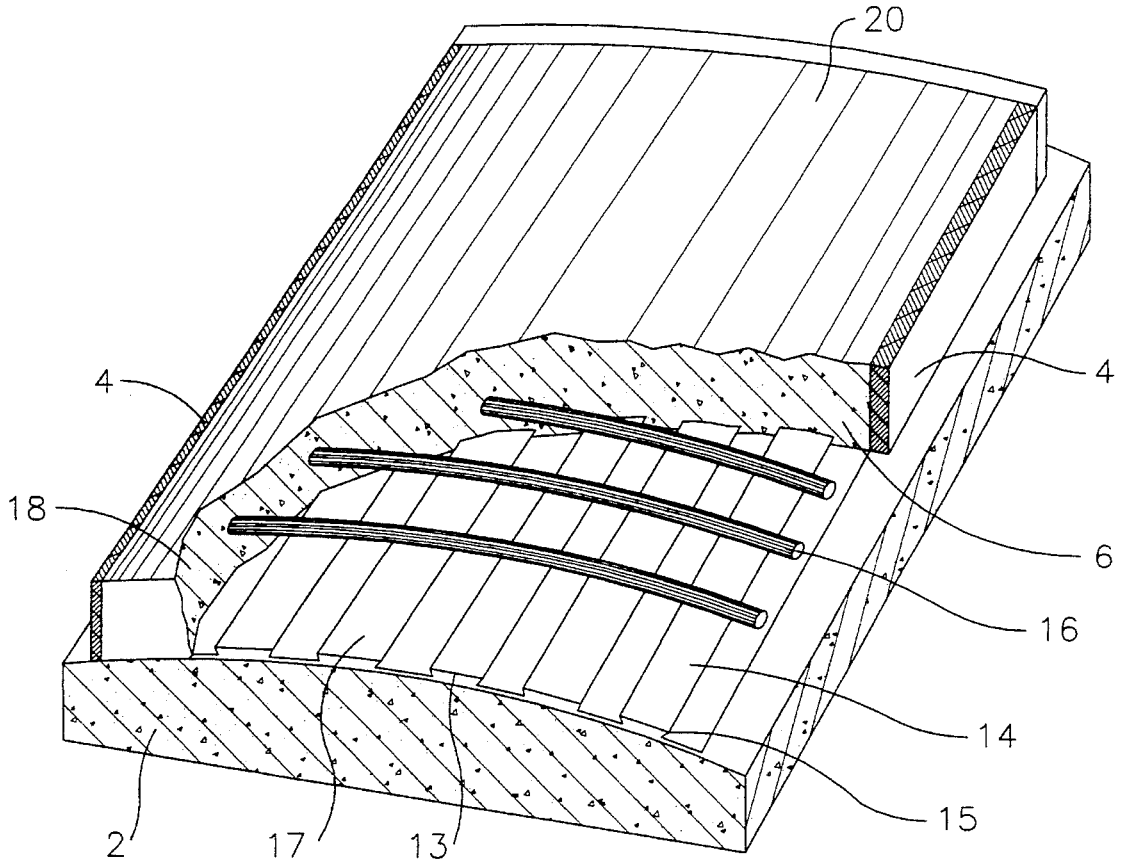
FIG. 3 reveals a supporting surface upon which a precast wall panel in accordance with a first embodiment of this invention is being created, in this instance a wall panel for a circularly shaped tank, with the convex portion of the panel upward, so as to receive concrete thereon.

In FIG. 3, I show a typical precast wall panel 6 in the essentially flat or prone position in which it is created. In accordance with this embodiment, I utilize a supporting surface 2 upon which is placed a waterproof diaphragm liner 14. This type of liner is typically made of sheet metal of a thickness in the range of 1/64 inch to 1/32 inch, having first face 13 and second face 17. I prefer for the diaphragm liner 14 to utilize regularly recurring corrugations 15, which are intended to reside in a vertically disposed manner in the finished precast wall panel 6. By way of illustration, the diaphragm liner 14 has flat sections approximately 3 to 4 inches in width, which are typically offset approximately 3/8 to 1/2 inches. As will be discussed hereinafter. in the construction of my novel wall panels I may also use diaphragm liners made of rubber.

Continuing with FIG. 3, the corrugations 15 are utilized in order to accomplish a mechanical interlocking of cementitious material onto both sides of the diaphragm liner 14, so as to avoid a plane of delamination being created. I prefer to use a diaphragm liner 14 made of sheet metal, which not only creates a watertight barrier, but it can be used as structural reinforcing.

In situations where the stored contents in the finished tank might have a deleterious effect on the concrete 18, the diaphragm liner 14 may be fabricated of a material which is normally resistant to the stored contents, and the cementitious coating 24 may be omitted. The normally resistant material which I prefer is stainless steel or PVC, but fiberglass, plastic, or other similar resistant materials can be used as well and will be described in greater detail in other embodiments. In the situation where the cementitious coating 24 is omitted, the loss of structural integrity will be made up in the remainder of the precast wall panel 6.

It is to be noted from FIG. 3 that edge forms 4 are utilized to define the dimensions of each precast wall panel that is created in this manner. Each edge form 4 produces an edge of the precast wall panel 6, which of course becomes the edge of the vertically disposed panel when the panel has been erected. These are hereinafter called the abutting edges 22, and are visible in FIG. 1 as well as in other locations. In the interests of creating wall panels of consistent size, I utilize considerable care in the placement of the edge forms 4 at the time the construction of each new panel commences.

Continuing with FIG. 3, it will be noted that concrete type material 18 is cast onto the diaphragm liner 14 to the design thickness of the precast wall panel 6. The thickness is consistent but not necessarily uniform. On smaller tanks the thickness might be uniform and on larger tanks the thickness might increase from the top to bottom of the precast wall panel 6. The concrete type material 18 typically is composed of cementitious material commonly known as concrete, or may be composed of other materials that can be formed in a flowable state and later hardened to create a substance with sufficiently high compression strength. Reinforcement composed of steel bars, metal ducts or other such components or materials can be placed in the precast wall panel 6 prior to hardening of the concrete 18.

As depicted in FIG. 3, several horizontal ducts 16, each concerned with providing a means for receiving a respective stressing member or tensioning member 26, are placed in the precast wall panel 6 prior to hardening of the concrete 18. These horizontal ducts 16, also referred to as elongate ducts, are clearly visible in FIGS. 4 through 6, can be effectively placed into position prior to depositing the concrete 18, or after the concrete 18 has been applied and prior to its setting. The elongate ducts 16 are thus made by creating a void in the panel at the casting time. These ducts can be made by removable forms or can be made by using any type of form material which can be left in the panel. Suitable materials for the horizontally disposed elongate ducts 16 will depend on use, and could be metal, PVC, or a specially prepared paper product.

After sufficient hardening, the precast wall panels 6 are erected vertically in the floor groove 34. As previously mentioned, one or more shims 36 are typically placed under each precast wall panel 6 in order to properly level and elevate the panel. The shims 36, which are visible in FIGS. 1 and 2 are commonly known in the industry. Each successive precast wall panel 6 is spaced apart from the adjacent precast wall panel 6 as it is set in the floor groove 34, for a reason that will become more apparent.

Figure 5:
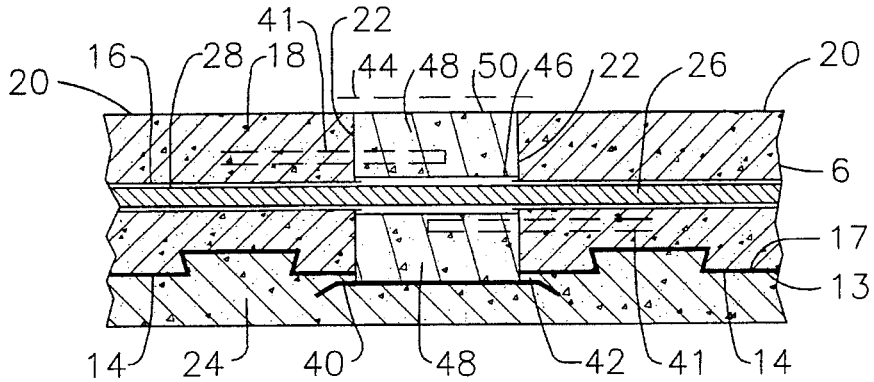
FIG. 5 is a horizontal cross-sectional showing similar to FIG. 4, with this view being taken at a location where a pair of precast wall panels are joined in accordance with the teachings of this invention.

After a sufficient number of precast wall panels 6 of appropriate configuration have been positioned in the configuration of the desired tank, a closure strip is completed between each adjacent pair of precast wall panels 6. As shown in FIG. 5, the closure strip consists of a liner strip 40 which is placed in contact with the diaphragm liner 14 of the two adjacent precast wall panels 6. The liner strip 40 is impervious to water and could be easily made of steel, fiberglass, or other suitable material. It is common for the liner strip 40 to be sealed water-tight to the diaphragm liner 14 with a sealant 42 or by metal crimping. The sealant 42 may be polysulfide, neoprene, epoxy, or other sealant commonly used in the trade.

The horizontal ducts 16 are advantageously made continuous from one precast wall panel 6 to the adjacent precast wall panel 6 by the use of suitable duct connectors 46; note FIG. 5. As will be understood by those skilled in the art, I provide for the ducts of all the panels being brought into a circumferential alignment. Each duct connector 46 may be composed of metal, PVC, paper, or other suitable material, and may be either circular or oval. Each duct connector 46 is positioned in the desired relationship adjacent the aligned elongate ducts 16 prior to concrete fill 48 being utilized for filling the closure strip between the precast wall panels 6. Typically, each duct connector 46 is taped in place, to prevent an undesired dislodgment thereof.

With regard to FIG. 5, the closure face 50 of the closure strip is formed by a suitable forming member 44, which may be made of wood, metal, or other suitable material. The closure face 50 is the finish wall surface at the closure strip and may be textured or provided with an architectural finish by attaching an architectural liner common in the industry to the forming member 44. After this forming member 44 has been positioned, the enclosed area between the precast wall panels 6 is then filled with concrete fill 48. The concrete fill 48 typically is conventional concrete, but in some instances it may be composed of a material that can be placed in the form in a flowable state and will thereafter reach sufficient rigidity.

Figure 4:
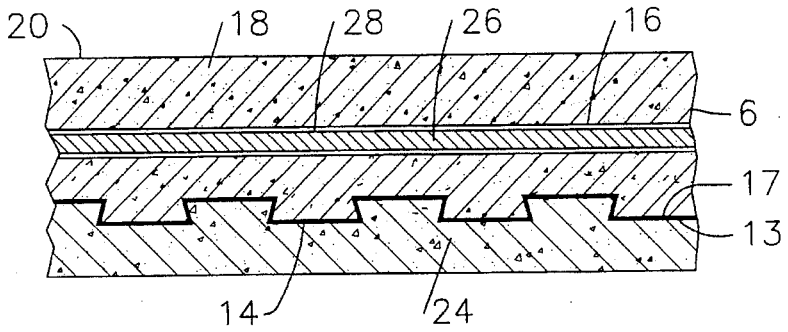
FIG. 4 is a horizontal cross-sectional view of a typical concrete wall section for a circularly shaped tank being created in accordance with this invention.
Figure 6:
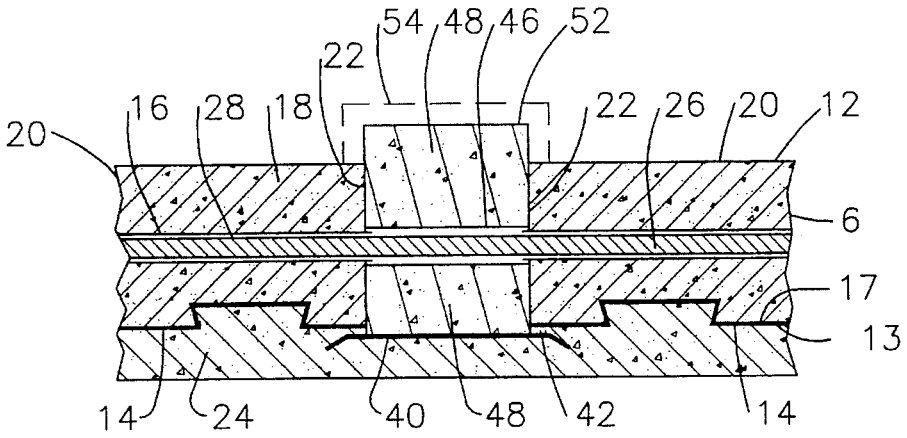
FIG. 6 is a horizontal cross-section view at the location of the closure strip between the precast wall panels, with this view including a decorative pilaster.

After the liner strip 40 has been properly positioned on the interior of the tank, a cementitious coating 24 is applied over what may now be regarded as the interior surface of the diaphragm liner 14, as well as over the liner strip 40, this being accomplished in the manner depicted in FIGS. 4, 5, and 6. The method and material that I prefer to use for this cementitious coating 24 is shotcrete, which is widely used in the industry. More particularly, the preferred material is a cementitious grout or small aggregate concrete which is applied to a thickness of approximately one inch. I am not to be limited to this material however.

This cementitious coating 24 protects the diaphragm liner 14 against corrosion and mechanical attack and becomes an integral part of the tank corewall. It is to be understood that the corewall is the portion of the prestressed tank wall which is placed in compression when the tensioning members 26 are tensioned.

When the wall 12 has been completed, and the cementitious coating 24, precast wall panel 6, concrete 18, and concrete fill 48 have each obtained sufficient strength, the stressing operation takes place, which consists of placing, tensioning and filling the interconnected, horizontal ducts 16. As will be seen hereinafter, the walls of all embodiments of my unique oval precast concrete tanks are stressed and completed in the same general manner.

With reference to FIGS. 4, 5, and 6, a steel tensioning member 26 of twisted wires commonly known as cable, or other suitable tensioning material, is threaded through the respective horizontal duct 16, starting at the buttress area. Although I am describing the placement of a single tensioning member 26, it is to be understood that it is typical to utilize as many tensioning members 26 as there are horizontal ducts 16. Furthermore, more than one tensioning member 26 can be placed in a single horizontal duct 16 where the horizontal duct 16 has been sized to accept multiple tensioning members 26, the practice of which is known in the industry.

Figure 7:
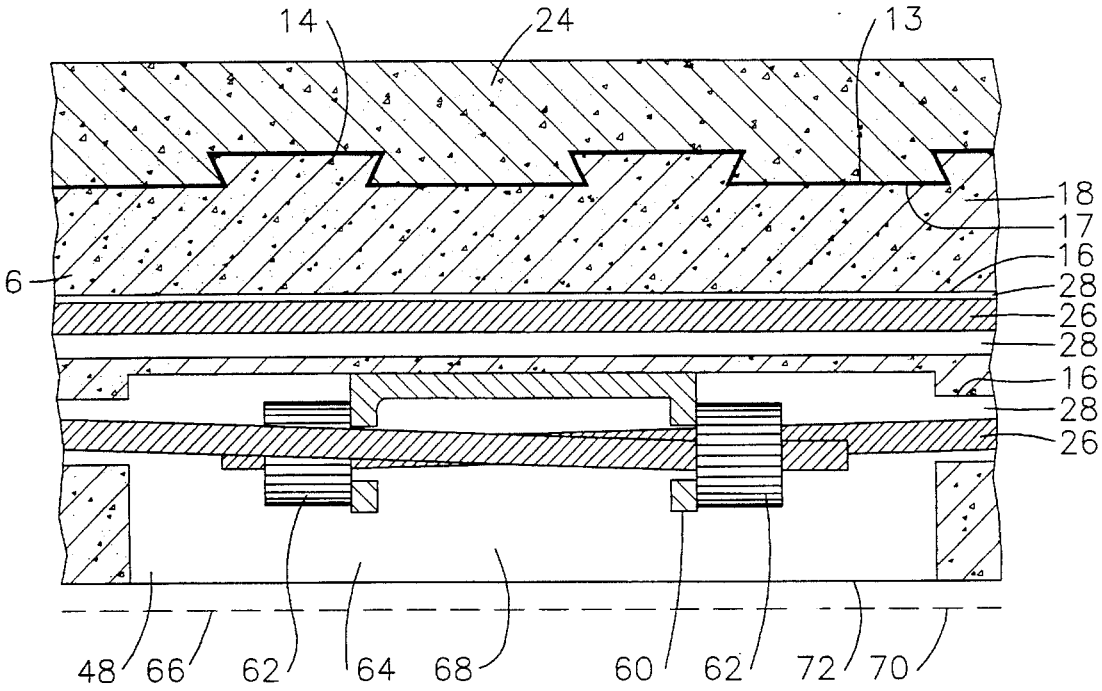
FIG. 7 is a horizontal cross-sectional view to a somewhat larger scale, illustrating the appearance of my novel wall at the location of a stressing buttress and depicting the tensioning anchoring means I prefer to use.

As depicted in FIG. 7, a buttress 60 is generally a vertically disposed structural member where the tensioning member 26 is tensioned. The buttress 60 shown is the preferred type where all stressing members 26 are attached to a single buttress 60, but alternate types of buttresses 60 are usable such as multiple buttresses where each tensioning member 26 has its own buttress 60. The tensioning member 26 passes through the respective horizontal duct 16 of each precast wall panel 6 then through the duct connector 46, FIG. 5, with this continuing until the tensioning member 26 exits from the final horizontal duct 16 at a buttress area. If desired, the placement of the tensioning members 26 through the interconnected, horizontally disposed ducts 16 can occur early in the construction sequence. For example, the tensioning members 26 can be inserted before each duct connector 46 has been placed and prior to filling the closure strip.

In the interest of economy on smaller sized tanks, where the outward circular ring tension forces on the precast wall panels 6 are not great, some or all of the tensioning members 26 along with the horizontal ducts 16 may be eliminated. In their place reinforcing bars 41 extend outward a few inches from the precast wall panel 6 along each vertical panel edge 22 into the closure strip. The reinforcing bars 41 are located in a slightly offset manner along the vertical panel edge 22 from adjacent precast wall panels 6 so that they will not intersect each other when the precast wall panels 6 are erected.

Therefore when the closure strip area between the fully cured precast wall panels 6 is filled with concrete fill 48 and the concrete fill 48 reaches a rigid state, as previously described, then the reinforcing bars 41 will be effectively bonded, allowing circular ring tension forces to be transmitted between precast concrete panels 6.

The tensioning member 26 is cut to a length sufficient that will permit threading from one buttress 60 through to another buttress 60 and connecting to tensioning equipment. As previously indicated, each elongate tensioning member 26 can be made of twisted steel wires commonly known as cable, or other suitable tensioning material.

Figure 8:
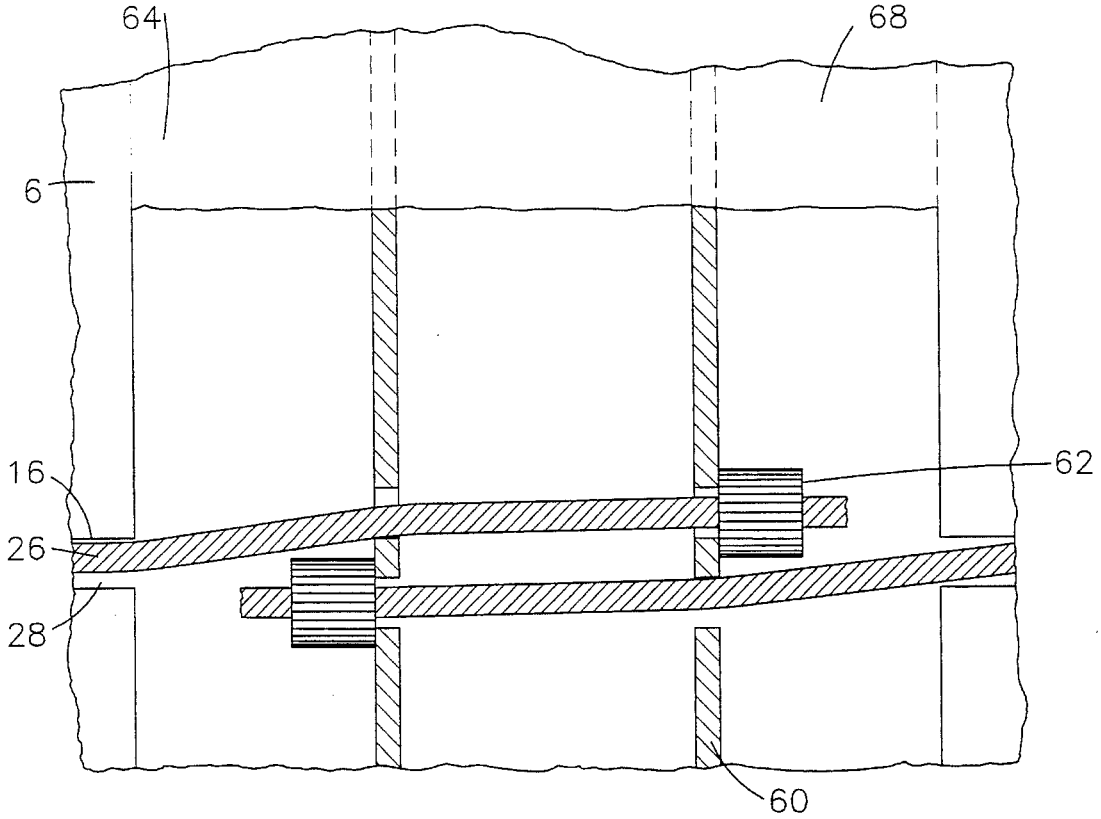
FIG. 8 is a frontal view of the prestressed concrete tank wall at the location of the stressing buttress.

The tensioning of the tensioning members 26 and the anchoring thereof is accomplished at a buttress area 60, such an area being depicted in FIGS. 7 and 8. Typically, all precast wall panels 6 of a circular tank will be quite similar in configuration and dimension, with the exception being that one or more panels will contain a buttress area 60. Each tank will have at least one buttress area, and may have several. In the instance that several buttress areas are utilized, they may be horizontally displaced from each other, around the outer circumference of the tank.

Multiple buttresses 60 can be used for any of several reasons, such as when more than one tensioning point is desired for reducing friction in tensioning members 26, and for ease of threading tensioning members 26 through the numerous horizontal ducts 16. When a number of tensioning members 26 are utilized, and it would be too difficult to fit them into a single buttress area 60, multiple buttresses are utilized.

FIG. 7 shows a typical horizontal duct 16 with the tensioning member 26 passing through such horizontal duct and terminating in the buttress area. It is to be noted that it is not necessary for each tensioning member 26 and horizontal duct 16 to terminate at every buttress area utilized on a given tank. Horizontal ducts 16 can pass continuously behind one buttress 60 and terminate at another buttress 60 in the case where multiple buttresses are utilized in a tank under construction.

The tensioning of the tensioning members 26 is performed with conventional methods well known in the industry. In FIG. 7 the horizontal duct 16 is shown to be discontinuous in the buttress area, with the tensioning member 26 passing through a buttress 60 and being held in place at one end by the use of a stressing anchor 62. The other end of the tensioning member 26 is then tensioned and a stressing anchor 62 is engaged to permanently hold the tensioning member 26 to a desired degree of tension. The stressing anchor 62 that I prefer to use consists of steel wedges deployed in a circular ring, which surround and grip the tensioning member 26 and is a common anchor in the industry.

Each tensioning member 26 is then tensioned by positioning and gripping it, and then elongating by the use of a hydraulic ram, which is common in the industry.

After the circumferentially extending tensioning members 26 are tensioned, a non-rigid corrosion-resistant material can be injected into the duct void 28 to prevent corrosion of the tensioning member 26. The injection starts in one end of the horizontal duct 16 located at the buttress area. The corrosion-resistant material is injected under pressure and continues filling the duct void 28 until the corrosion-resistant material comes out the other end of the horizontal duct 16 in the respective buttress area.

A cover plate 66 can be placed over the buttress area and the void created by the cover plate 66 can be filled with a non-rigid, corrosion-inhibiting material 64; note FIG. 7. A corrosion-resistant material with lubricating properties can be either placed on the tensioning member 26 or in the horizontal ducts 16 prior to threading the tensioning member 26 through the aligned array of horizontal ducts 16. At some time in the future, the tensioning members 26 can be removed and inspected by removing the cover plate 66, the stressing anchor 62, and extracting the tensioning member 26 from the horizontal duct 16. The prestressed concrete tank 10 could be only partially or totally emptied at this time. The tensioning member 26 can then be threaded back through the horizontal duct 16 and re-tensioned.

If desirable, additional tensioning members 26 can be placed into the horizontal duct 16 and then tensioned to give additional reinforcement to the tank. In this instance, compressed air may be used to blow a light line through the horizontal duct 16, followed by heavier line, and then a sufficiently strong line is used for pulling the additional tensioning member 26 through the horizontal duct 16. If desired, a non-rigid, corrosion-resistant material can be again placed in the duct void 28. The cover plate 66 is replaced over the buttress area and the void created by the cover plate 66 filled.

Where a permanently bonded tensioning member 26 is desired, it can be achieved by injecting a fluid material into the horizontal duct 16 to fill the duct void 28. The material will then harden, creating a rigid bond between the tensioning member 26 and the horizontal duct 16. This material may be an epoxy or other cementitious grout well known in the industry. After the duct void 28 is filled, a form 70 is placed over the buttress and a concrete fill 48 is placed in the buttress area. The form 70 is then removed, giving the finish buttress surface 72. The form 70 may be lined to give an architectural appearance in a manner similar to that described for the closure strip.

If desired, the closure strip utilized between the precast wall panels 6 can be constructed so as to protrude past the finished tank wall surface 20 and produce a decorative pilaster; note FIG. 6. This is done by constructing a form 54 to define the decorative pilaster finished surface 52 so that when the concrete fill 48 is poured in the closure strip, it forms a decorative pilaster with relief from the tank wall 12.

If desired, a decorative finish can be given to the finish tank wall surface 20 while a precast wall panel 6 is being constructed. This surface treatment can be a simple finish common in the trade such as a broom finish, float finish, or trowel finish. Alternately, a decorative finish can be added by engraving, stenciling, or stamping into the panel a particular design. Tools for engraving, stenciling, or stamping are known in the trade.

Figure 9:
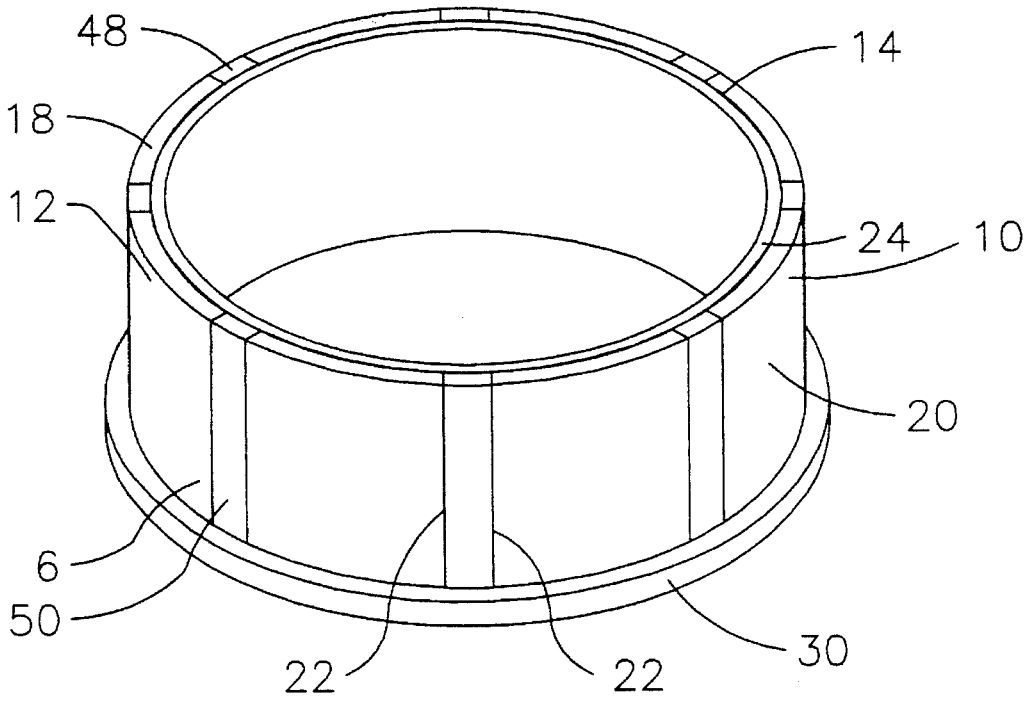
FIG. 9 is an isometric or perspective view of what I regard as a generally oval prestressed concrete tank, this particular tank being one of circular configuration and residing on a suitable floor.

It is quite obvious that my invention is admirably suited for use in the construction of several different tank embodiments of generally oval configuration, which includes tanks that are circular, generally circular, elliptical, generally elliptical, elongate, and the like, and in FIG. 9 I show an isometric or perspective view of what may be regarded as a generally oval prestressed concrete tank, with this particular tank being one of circular configuration. This is to be seen as a first embodiment of my invention, and the wall panels for this tank may be made by the use of the supporting surface depicted in FIG. 3.

Figure 10:
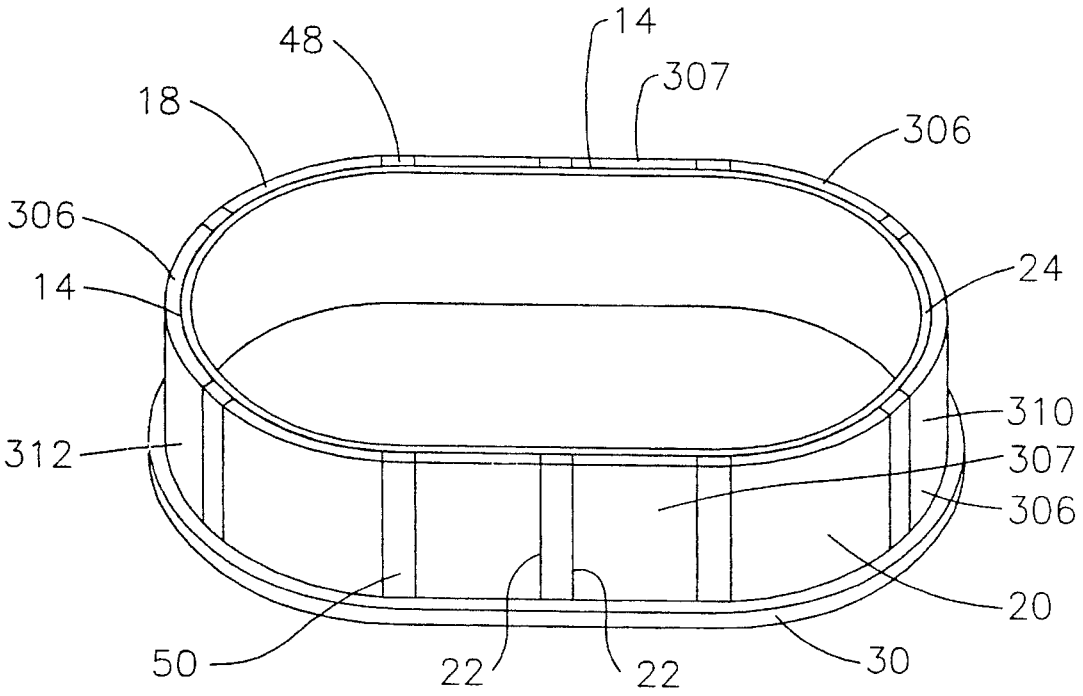
FIG. 10 is an isometric or perspective view of a generally oval prestressed concrete tank of elongate configuration, and also residing on a suitable floor.
Figure 11:
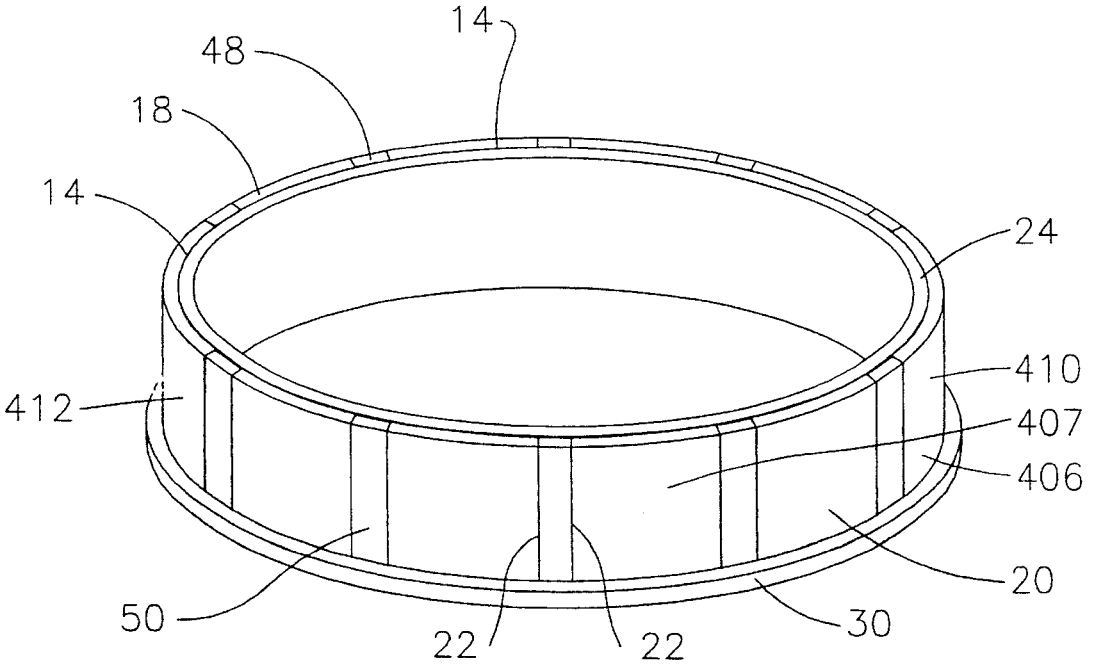
FIG. 11 is an isometric or perspective view of a generally oval prestressed concrete tank of elliptical configuration, resting on a suitable floor.

FIG. 10 is an isometric or perspective view of a generally oval prestressed concrete tank of elongate configuration, which may be regarded as a second embodiment of my invention, whereas FIG. 11 is an isometric or perspective view of a third embodiment, which is a generally oval prestressed concrete tank of elliptical configuration, with each of these tanks resting on a suitable floor.

Figure 13:
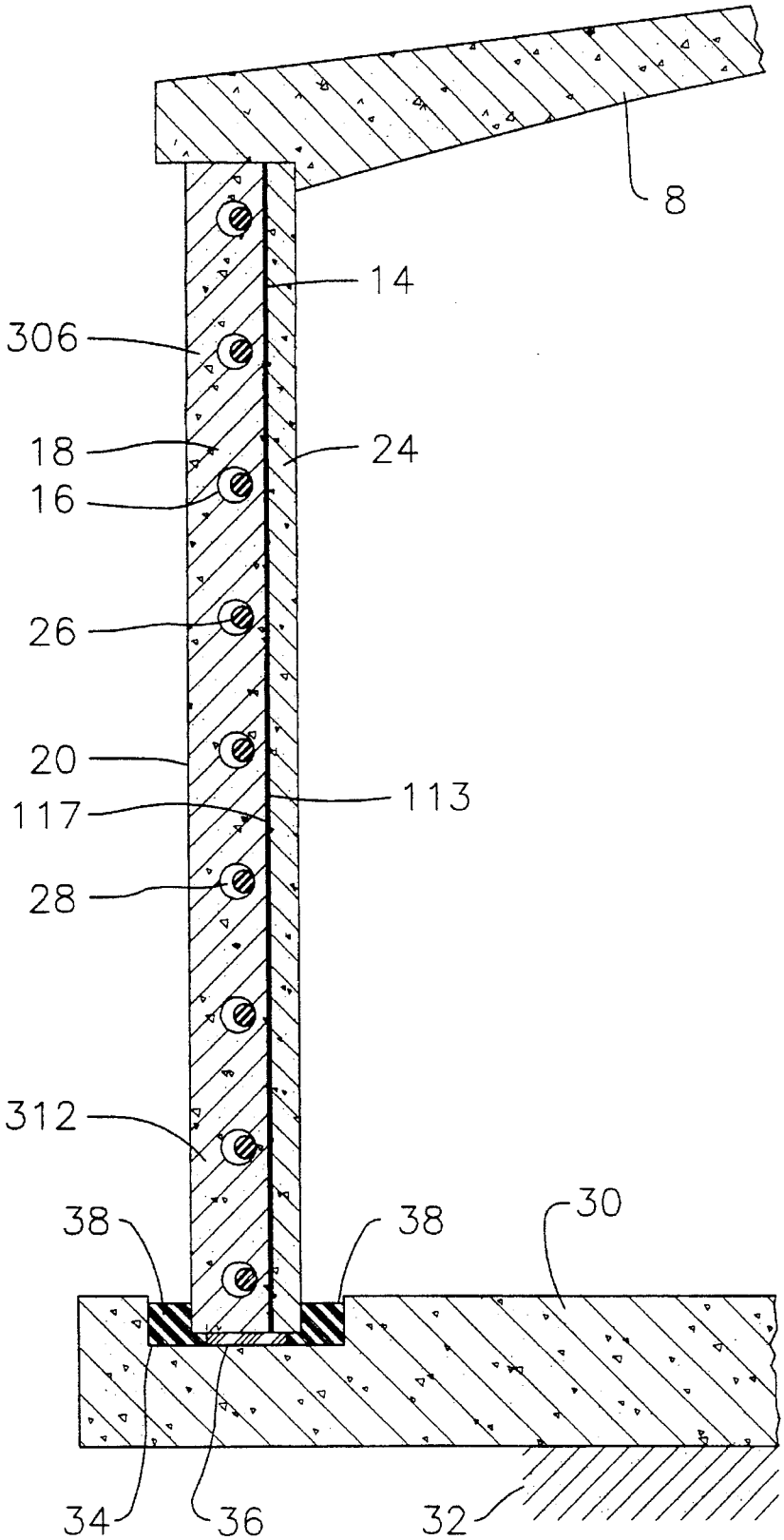
FIG. 13 is a sectional view of a prestressed concrete oval tank showing the tank wall and its interaction with the floor and also revealing a section of the roof of the tank.

Continuing with FIG. 9, the generally oval tank 10 of circular configuration has a floor 30 upon which the tank wall 12 is constructed. Depending on the application, a roof 8 of the type shown in FIGS. 2 and 13 can be incorporated into the tank, but for clarity, the roof has been omitted from FIGS. 9, 10 and 11. The roof 8 and floor 30 are known in the industry and have been previously described.

As should be entirely clear, the tank of FIG. 9 has a generally oval wall composed of a plurality of precast wall panels 6. These precast wall panels 6 are of a consistent configuration, being generally rectangular, with parallel sides and parallel top and bottom, and having a uniform curvature. Precast wall panels of this type are ideal for constructing circular (cylindrically shaped) tanks.

Figure 14:
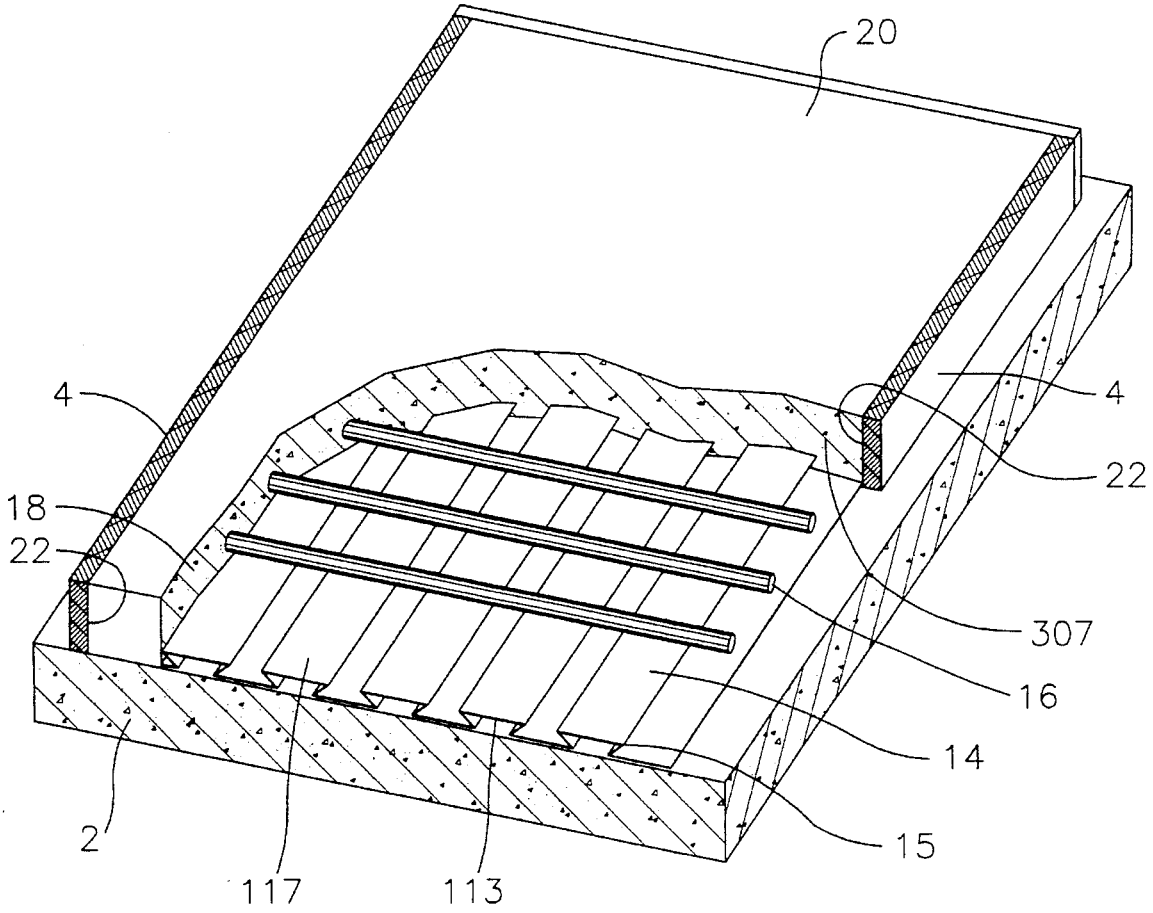
FIG. 14 reveals a flat supporting surface upon which a substantially flat precast wall panel is being created, which flat wall panel is primarily intended for utilization along the sides of generally oval tanks of elongate configuration.

Turning now to the supporting surfaces utilized for the building of wall panels in accordance with this invention, it will be noted that FIG. 14 reveals the use of a supporting surface 2 that is substantially flat. It is to be understood that panels made from a flat supporting surface 2 are to be used in the construction of the substantially flat sides of an elongate tank, of the type depicted in FIG. 10.

Figure 15:
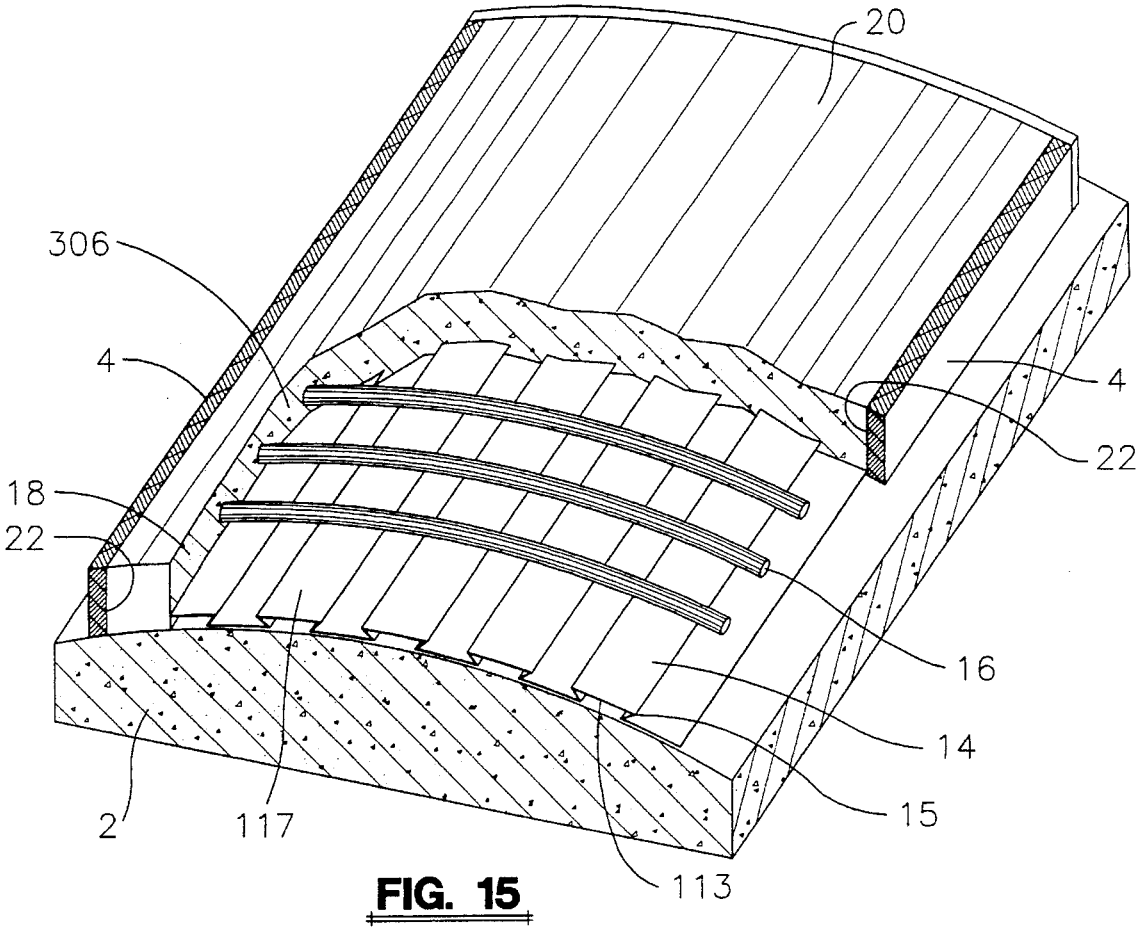
FIG. 15 reveals a supporting surface upon which a precast wall panel is created in accordance with the requirements for wall panels possessing substantial curvature, which type of wall panel is primarily intended for use at the ends of an elongate or a generally elliptically shaped tank, with the convex portion of the supporting surface being upward, so as to receive concrete thereon.

With reference to FIG. 15, it is to be seen that the supporting surface 2 in this instance has substantial curvature, which is ideal for the construction of the substantially curved wall panels needed for the ends of tanks of either elongate or elliptical configuration. In contrast with the showing of FIG. 15, in FIG. 16 the supporting surface 2 is only slightly curved, making this surface ideal for the construction of wall panels utilized for the sides of an elliptical tank, of the type depicted in FIG. 11.

lilt is to be understood that the curvature of the wall panels created by the use of these different supporting surfaces is of considerable importance to the construction of the several different tanks of generally oval configuration in accordance with this invention. As is obvious, each wall panel utilized in the tank illustrated in FIG. 9 has consistent configuration, whereas in FIGS. 10 and 11, the precast wall panels have different curvatures at different locations in the generally oval tank wall.

Circular tanks of the type depicted in FIG. 9 are frequently used for water storage and/or water treatment, as well as for the storage and/or treatment of sewage, and by way of example these tanks can range between a diameter of 30 feet and a diameter of 160 feet, with the height of the tank walls being between 8 feet and 35 feet. The width of the individual panels can be between 8 feet and 16 feet, with a panel for a tank 80 feet in diameter being on the order of 12 feet. The thickness of a panel 12 feet wide can be a consistent 3½ inches, and the "lift," meaning the rise of the center of a panel with respect to the edges, can be on the order of 6 inches. As is obvious, I am not to be limited to any of these dimensions.

It is to be noted that the circular tank 10 is typically the most economical to construct of the several embodiments of this invention inasmuch as it represents the most efficient use of wall area per volume. A circular tank provides great efficiency because the wall thickness and subsequent prestressing can be optimized.

A second embodiment of my invention is depicted in FIG. 10, which is an elongate tank 310 that may be used where site restrictions do not necessarily permit the installation of a more economical circular tank of the type illustrated in FIG. 9. For example, if the site is longer than it is wide, the use of the elongate tank is ideal.

A typical use for an elongate tank is for wastewater treatment where unique processes effectively utilize this shape and includes an interior bafflewall spaced equally between the straight walls. The bafflewall is typically as long as each straight wall, and by its use, the flow can be directed around in what may be regarded as a racetrack configuration. The economy of the prestressed circular ends can be realized in the elongate tank embodiment.

An elongate tank of the type depicted in FIG. 10 can range between 60 and 240 feet in length, with a width of 40 to 180 feet, and with the height of the walls being from 10 to 20 feet. A typical panel width can be between 8 feet and 16 feet, and the panels utilized at the ends of the tank may have a radius of curvature between 20 feet and 90 feet.

For an elongate tank 120 feet long and 80 feet wide of the type illustrated in FIG. 10, a typical panel width may be on the order of 12 feet, with the radius of curvature of the substantially curved end panels being 40 feet, and with the height of the wall panels being approximately 14 feet. In such instance, the "lift" of the vertical centerline of a substantially curved end panel with respect to the vertical side edges of the panel can be on the order of 6 inches.

The curved ends of the elongate tank 310 benefit greatly from their generally circular shape. The straight walls, on the other hand, do not have the same benefit of the ring tension brought about by the use of the circumferentially extending stressing members 26. The design of a generally oval tank of elongate configuration incorporates minor bending in the vertical direction in the wall of the ends of the tank, whereas the straight wall section has a significant amount of vertical bending in the wall, which requires the flat precast wall panels 307 to be significantly thicker. Generally they will be thicker at the bottom and taper up to a minimum thickness at the top. The thickness at the bottom of each panel may for example be twelve inches and the thickness at the top may be three inches.

It is to be understood that the elongate tank 310 depicted in FIG. 10 has walls 312 of two different configurations, and in plan view this tank is shaped essentially like a circle that has been bisected, the halves moved apart, and substantially straight walls added to connect the ends of the bisected circles. As indicated above, the ends of the elongate tank 310 comprise precast wall panels 306 which possess substantial curvature, which form a semi-circle at each end of the elongate tank 310. Each elongate wall section 312 between the curved ends of the elongate tank 310 is substantially straight and is made up of precast wall panels 307 which are substantially flat. The supporting surface 2 depicted in FIG. 14 may be utilized in the construction of the flat panels 307.

A third embodiment of my novel generally oval tank is shown in FIG. 11, where a completed elliptical tank 410 in accordance with this invention is shown. The ends of the elliptical tank 410 are composed of substantially curved precast wall panels 406 which are significantly or steeply curved and are assembled to form an approximate semi-circle that is somewhat less than a half circle. The supporting surface 2 depicted in FIG. 15 is typically used for constructing the substantially curved ends of the elliptically shaped tank.

The distance from the furthest point of one end of the elliptical tank 410 of FIG. 11 to the corresponding opposite end is termed the length of the tank, and the distance perpendicular to the length is termed the width. Typically the radius of curvature of the substantially curved precast concrete panels 406 is slightly less than one half of the width of the elliptical tank 410. The section of elliptical wall 412 between the semi-circular ends formed by the substantially curved precast concrete panels 406 is made of panels of a configuration that may be regarded as slightly curved precast wall panels 407. The slightly curved precast wall panel 407 is similar in most respects to the substantially curved precast wall panel. 406, the difference being in the radius of curvature, which is significantly greater and the curvature of the panel is considered mild when compared to the substantially curved precast wall panel 406. The radius of curvature of the slightly curved precast wall panel 407 is typically at least three times the radius of curvature of the substantially curved precast wall panel 406. As the radius of curvature of the slightly curved precast wall panels 407 increases, the semi-circular end of the tank goes closer to forming a half circle. The layout of the walls can be carried one step further by including walls of a third configuration where the radius of curvature would be between the first and second configuration. It is my preference to omit this third configuration for economic reasons.

The overall length and width dimensions of the elliptical tank can be expected to have a ratio in the range of 2:1 to 6:1.

The curvatures mentioned for reasons of clarification have referred to curvature in a horizontal plane only, and it is to be understood that curvature in the vertical direction can be built into any of the precast wall panels of any of my embodiments. An example of the resulting shape could be similar to the shape of a football standing on end.

The elliptical tank 410 has the advantage of circular members composing its sides and thereby benefiting from circumferential ring tension induced by the use of the stressing members 26. The ends composed of the substantially curved precast wall panels 406 are typically thicker than the ends of a corresponding elongate tank 310 or circular tank 10 with precast wall panels 106 of this same radius of curvature. The amount of stress induced by the stressing members 26 will be proportional to that required to induce the desired ring compression in the slightly curved precast wall panels 407 which is a function of the panel's radius of curvature. The difference between the substantially curved precast wall panel 406 and the slightly curved precast wall panel 407 required ring tension is directly proportional to the radius of curvature. By example, if the slightly curved precast wall panel 407 had a radius of curvature three times the substantially curved precast wall panel 406 then approximately three times as much ring compression would need to be induced by the stressing members 26. Thereby the corresponding thickness of the precast wall panel 6 would have to be designed to accept the ring compression. The advantage that the elliptical tank 410 has over the elongate tank 310 is that all the walls can be placed in ring compression induced by the stressing members 26 and thereby eliminating problems that occur with significant vertical bending in the wall section. By way of example, a tank constructed out of precast wall panels 6 that have a degree of curvature will have no vertical bending if at the connection between the bottom of the precast wall panel 6 and the tank floor 30 there is no friction. On the contrary, a tank with a flat or straight wall as made up of flat precast wall panels 307 must have a positive fixed relationship between the flat precast wall panel 307 and the floor 30, thereby creating a significant vertical bending moment.

More specifically, the elliptically shaped tank depicted in FIG. 11 may range in length from 60 to 240 feet, and have a width ranging between 40 feet and 180 feet. A typical panel width is between 8 feet and 16 feet, with the height of such panels ranging between 10 feet and 20 feet. The radius of curvature of the substantially curved end panels may range between 20 feet and 90 feet whereas the radius of curvature of the slightly curved side panels of the elliptically shaped tank may range between 60 feet and 240 feet.

Assuming an elliptically shaped tank is 120 feet long and 94 feet wide, the panel width can be on the order of 12 feet and the height of these panels can be on the order of 14 feet. All the panels can have a top thickness of approximately 3½ inches and a bottom thickness of 4½ inches.

For the substantially curved wall panels 406, the radius of curvature can be 40 feet and the lift of the panel can be approximately 6 inches, whereas the radius of curvature for the slightly curved wall panels 407 can be 120 feet and the lift approximately 2 inches.

It is thus far to be seen that in each instance the precast wall panels are created by placing a suitable diaphragm liner 14 on a supporting surface 2, with the first face 113 directed downwardly onto the supporting surface 2, whereas the second face 117 faces away from the supporting surface, which may be regarded as the up direction. The first face 113 is of course closer to the intended contents of the tank. When a precast wall panel possesses a degree of curvature as earlier depicted in FIG. 3, and as now set forth in FIGS. 15 and 16, the first face 113 may be referred to as concave and the second face 117 referred to as convex.

Importantly, a plurality of elongate ducts 16 are spaced in a parallel relationship above the second face 117 of the diaphragm liner, and in a consistent pattern. Concrete 18 is poured to a consistent depth over the second face 117 so as to encase the elongate ducts 16. As is noted in FIGS. 3, 14, 15 and 16, an edge form 4 is used to control the thickness and shape of each wall panel being constructed. Prior to the concrete 18 hardening, it is shaped and textured to a finished condition suitable for the finish tank wall surface 20, which will of course be the exterior of the completed generally oval tank.

After the concrete 18 of each of the precast wall panels has hardened, a plurality of precast wall panels is assembled on the floor slab 30 as a generally oval tank of the desired configuration. The abutting edges 22, which are sometimes called vertical panel edges, are spaced closely together, and because of the consistency of the positioning of the elongate ducts 16 during the construction of the panels, the ducts of the several panels can be expected to come into alignment.

After the panels have been positioned, an elongate tensioning member 26 of appropriate length and sufficient strength is inserted through the aligned elongate ducts 16 of the assembled precast concrete panels, in the manner illustrated in FIGS. 1, 2, 4, 5, 12, 13, 17 and 18.

The adjacent, closely spaced precast wall panels are connected in a manner shown in FIGS. 5, 6, 18 and 19, with appropriate concrete fill 48 being utilized at each juncture. After the concrete fill 48 hardens and gains sufficient strength, tension is applied to the circumferentially extending tensioning member 26 in a manner described in conjunction with FIGS. 7 and 8, with the abutting edges of the precast wall panels 6 thus being drawn tightly together.

In most instances it is highly desirable to apply a cementitious coating 24 over the first face of the diaphragm liner 14, which procedure is applicable to all embodiments of my invention.

All of the embodiments of my present invention include the wall resting on a floor 30 as shown in FIGS. 9, 10 and 11 as was presented in detail in my first embodiment.

Figure 12:
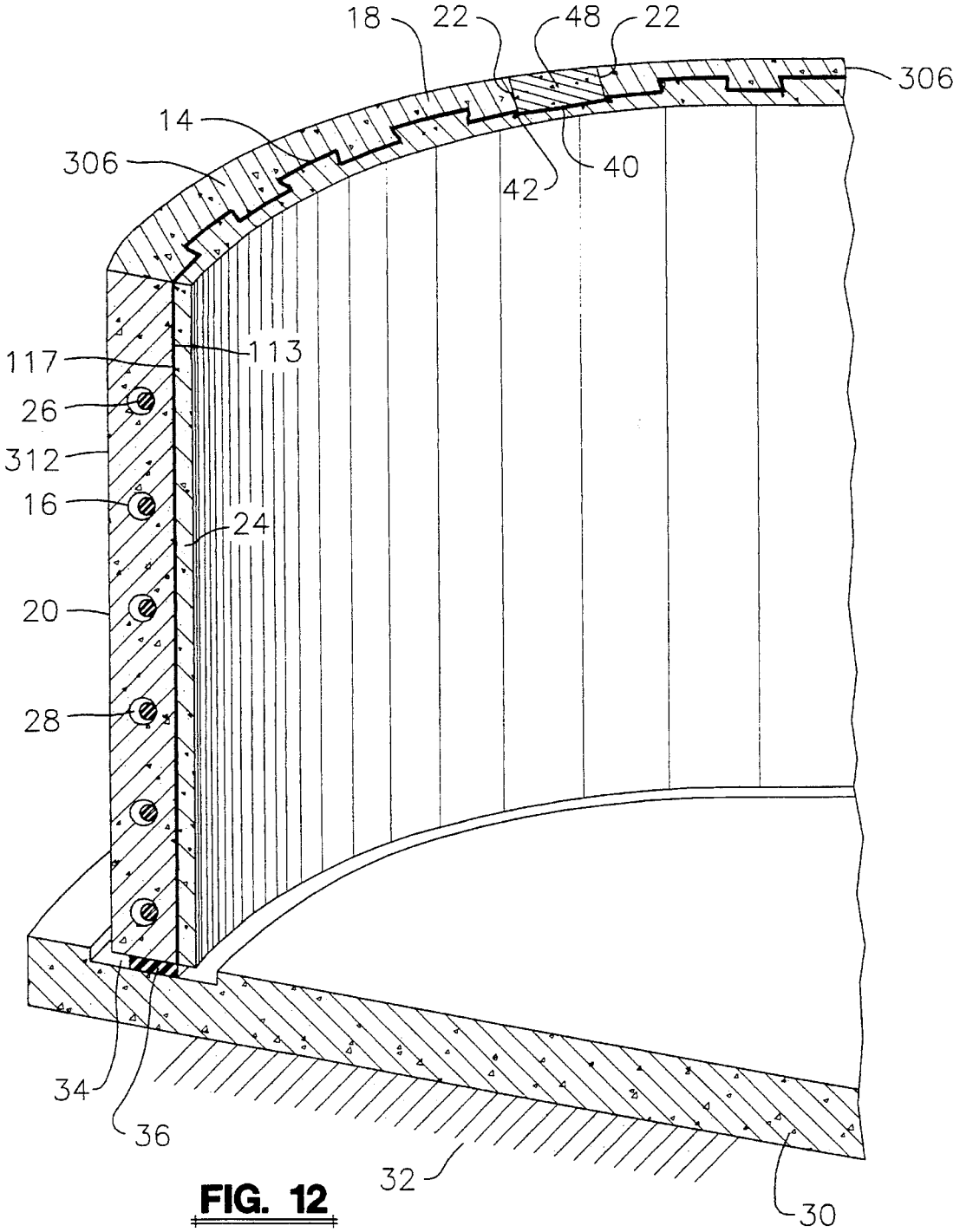
FIG. 12 is a perspective view to a larger scale of a section of a prestressed concrete tank of a generally oval configuration, in this instance showing a pair of precast wall panels residing in an abutting relationship.

In a manner similar to FIG. 1, FIG. 12 shows a portion of the completed oval tank wall comprised of a pair of precast wall panels 306 disposed in an abutting relationship. The elongate wall 312 in FIG. 12 may, however, involve a substantially curved precast wall panel 306 and a flat precast wall panel 307 joined together in an abutting relationship. In other words, panels of unlike configuration of the elongate tank 310 embodiment may be joined together in the same general manner as are panels of like configuration. The elliptical wall 412 has the precast wall panels arranged in a similar manner. It is obvious that the substantially curved precast wall panels 406 and the slightly curved precast wall panels 407 will be arranged in an abutting manner similar to that shown in FIG. 12 and previously described.

Panels of like configuration of this embodiment are also joined together in the same manner as the substantially curved precast wall panel 406 and the slightly curved precast wall panel 407 as previously discussed.

With specific attention to the flat precast wall panel 307 made in accordance with FIG. 14, it has previously been described that the supporting surface 2 depicted in this figure is flat and is used in the construction of the wall panels to be used on the straight sides of the elongate tank illustrated in FIG. 10. A typical panel width is 12 feet and the panel thickness may for example be 3½ inches at the top and 8 inches at the bottom.

With regard to the significantly curved panels made by the use of the supporting surface 2 illustrated in FIG. 15, for the elongate tank the panel width can be 12 feet, the radius of curvature 40 feet and the lift 5 inches, with the panel thickness being for example a uniform 3½ inches.

On the other hand, for the elliptically shaped tank the same dimensions as for the elongate tank may apply except that the top thickness may be 3½ inches and the bottom thickness 4½ inches.

Figure 16:
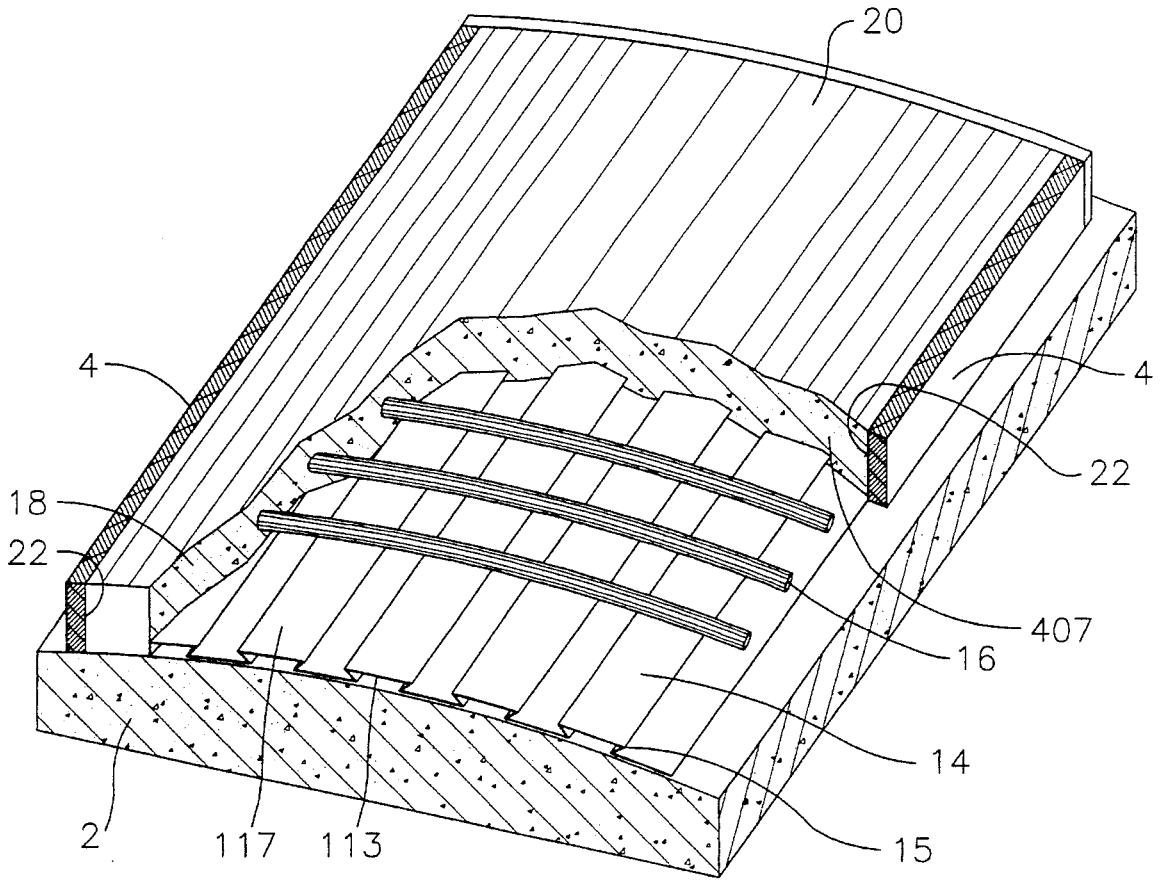
FIG. 16 reveals a supporting surface upon which a precast wall panel in accordance with another embodiment of this invention is being created, which is a wall panel possessing slight curvature that is primarily intended for utilization along the sides of a generally elliptically shaped tank, with the convex portion of the supporting surface upward, so as to receive concrete thereon.

Turning to the slightly curved precast wall panel 407 depicted in FIG. 16, the panel width can be 12 feet, the radius of curvature 120 feet, and the lift approximately 2 inches.

Regarding the diaphragm liners illustrated in FIGS. 14, 15 and 16, it can be seen that in each instance the first face 113 of the diaphragm liner 14 is laid on the supporting surface 2 and the second face 117 is opposite from the supporting surface 2.

It is important to note that all of the panels illustrated in FIGS. 3, 14, 15 and 16 have been shown in an essentially prone position. This is considered the most economical way of making the panels. Another method of fabricating the panels, which has been successfully utilized, is to tilt the supporting surface 2 in a near vertical position. This will require a form to be used on the side of the precast concrete panel opposite the supporting surface 2. This form is fastened to edge forms 4 and will contain the concrete and create and texture the finished tank wall surface 20. A way of carrying this one step farther is to produce the precast wall panel with the supporting surface 2 in a near vertical position and elevating the diaphragm liner 14 a uniform distance above the supporting surface 2 and pouring cementitious material 24 between the diaphragm liner 14 and the supporting surface 2 in this vertical position. In doing so, the cementitious coating 24 can be applied to the first face of the diaphragm liner at the same time that the concrete 18 is applied to the second face of the diaphragm liner 14.

I have been very careful in performing this procedure to insure that the cementitious coating 24 on the first face of the diaphragm liner 14 and the concrete 18 on the second face of the diaphragm liner are poured together so that the diaphragm liner will not be dislodged from its desired position. Another way of accomplishing the placement of the concrete 18 on the second face of the diaphragm liner and the cementitious coating 24 on the first face of the diaphragm is to construct the precast concrete panel in accordance with the method previously described, and after the precast concrete panel sufficiently hardens, turn it over so that the first face is now directed upwardly. The supporting surface 2 is removed and cementitious coating 24 is then poured over the first face. This cementitious coating 24 in this case is often a concrete material quite similar to that placed on the second face of the diaphragm liner. This method of flipping over the precast concrete panel will work in very small applications where the weight of the panel is not a significant factor, and it is possible to turn the panel over and move it without damaging the panel.

The method of constructing the precast concrete panel 106 for all embodiments is illustrated in FIGS. 14, 15 and 16 in a manner to that previously described in conjunction with FIG. 3. The basic and unique difference between the illustrations of FIGS. 3, 14, 15 and 16 is the curvature in the supporting surface 2.

The flat panel depicted in FIG. 14 has virtually no curvature and is constructed in a manner similar to the panels with curvature. Typically the flat panel has a wall thickness that is approximately twice as thick at the bottom as at the top, and there may also be additional reinforcing steel in the flat panel. The need for the additional thickness at the bottom is caused by the increased vertical bending in a straight wall section.

It is to be noted that FIG. 15 shows a precast wall panel having substantial curvature, with the supporting surface 2 being responsible for creating a substantially curved precast wall panel 306 which may for example be used in the circular tank 10; in the ends of the elongate tank 310; and in the ends of the elliptical tank 410. The radius of curvature of the supporting surface 2 is approximately one half of the smallest distance across the oval tank when measured across the center of the oval tank. By way of example, in a circular tank 10 the radius of curvature is one-half the diameter of the tank. In the elongate tank 310, the radius of curvature is one-half the perpendicular distance between the flat precast wall panels 307. In the case of the elliptical tank 410, the radius of curvature of the substantially curved precast wall panel 406 shown in FIG. 15 is a little less than one-half of the width of the tank.

FIG. 16 shows a slightly curved precast wall panel 407, wherein the radius of curvature is typically three times the radius of curvature of the substantially curved precast wall panel 406 used on the end of the elliptical tank 410. The slightly curved precast wall panel 407 shown in FIG. 16 is used to make the part of the elliptical tank 410 wall between the substantially curved precast wall panels 406 which comprise the ends of the elliptical tank 410.

It is to be understood that a precast wall panel in accordance with this invention may vary in thickness from a minimum of approximately three inches to a maximum of approximately fifteen inches. Typically a panel is thin at the top with a 3½ inch minimum dimension and at the bottom the thickness is dictated by the required compressive strength of the panel. The width of a precast wall panel will vary from a minimum of approximately eight feet when the precast wall panels are being fabricated and transported to the construction site. In situations where it is found economical to actually fabricate the precast wall panels on the construction site, their width may vary from eight feet to sixteen feet. The length or height of the precast wall panel will essentially be the same as the height of the finished tank wall.

Figure 17:
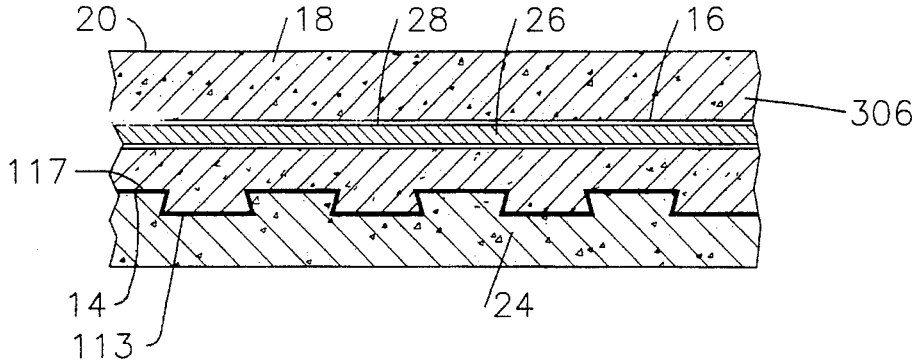
FIG. 17 is a horizontal sectional view of a typical wall panel for an elliptical or an elongate tank.

FIG. 17 shows a cross sectional view of the precast concrete panel 306 taken from a horizontal plane. The features of this embodiment are generally the same as those previously presented in the first embodiment and described in the cross section view of that embodiment, which is FIG. 4.

The precast wall panels for all embodiments of the oval tank are erected in a similar manner to that previously described.

Figure 18:
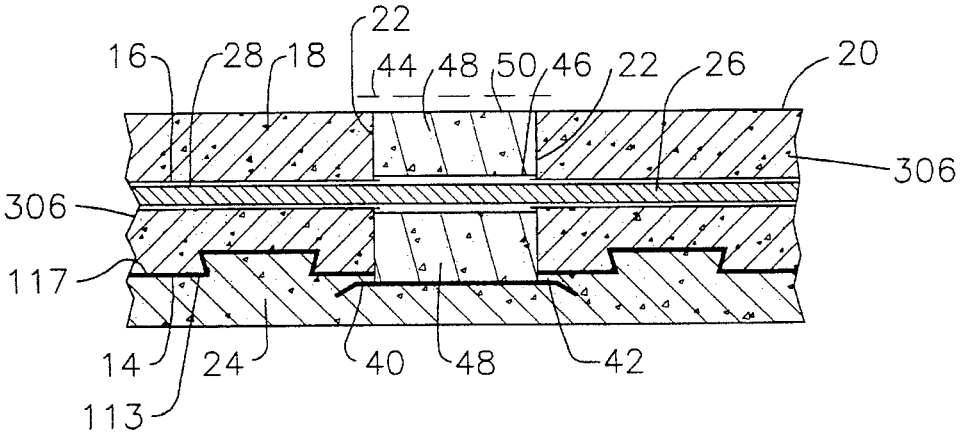
FIG. 18 is a horizontal cross sectional view similar to FIG. 17 with this view being intended to indicate that a wall panel of one curvature may be joined to a wall panel of a different curvature.

The closure strips for all embodiments of my generally oval tank are shown in FIG. 18 and are accomplished in a manner as described earlier. It will be recalled from the description of the closure strip in the first embodiment that the elongate ducts 16 are made continuous with the duct connector 46, and how the diaphragm liner 14 is made continuous by the use of a liner strip 40 and a sealant 42. In like manner it can be recalled that the concrete fill 48 is placed between the abutting edges 22 and the closure face 50 is formed by the forming member 44.

FIG. 18 shows that the panels connected together are all connected in a similar manner regardless of the curvature of the panel or location in the tank wall. For instance, in the case of the elongate tank 310 the substantially curved precast wall panels 306 are connected to each other in a manner described as FIG. 18 and the flat precast wall panels 307 are connected to each in the same fashion. This is also the case when the substantially curved precast wall panel 306 is connected to the flat precast wall panel 307. It will also be recalled from the preceding discussion of the first embodiment that after the closure strip has been completed and the cementitious coating 24 applied over the diaphragm liner 14, the wall is allowed to harden and gain strength. At this time, the precast wall panels 6 are typically aged and of sufficient strength for application of the tension to the tensioning members. However, the concrete fill 48 and the cementitious coating 24 typically require seven days to gain sufficient strength. The tensioning of the tensioning members 26 and the construction and placement of the buttresses 60 are performed in a manner as previously described in the first embodiment and here the specific parts are shown in FIG. 20.

Figure 20:
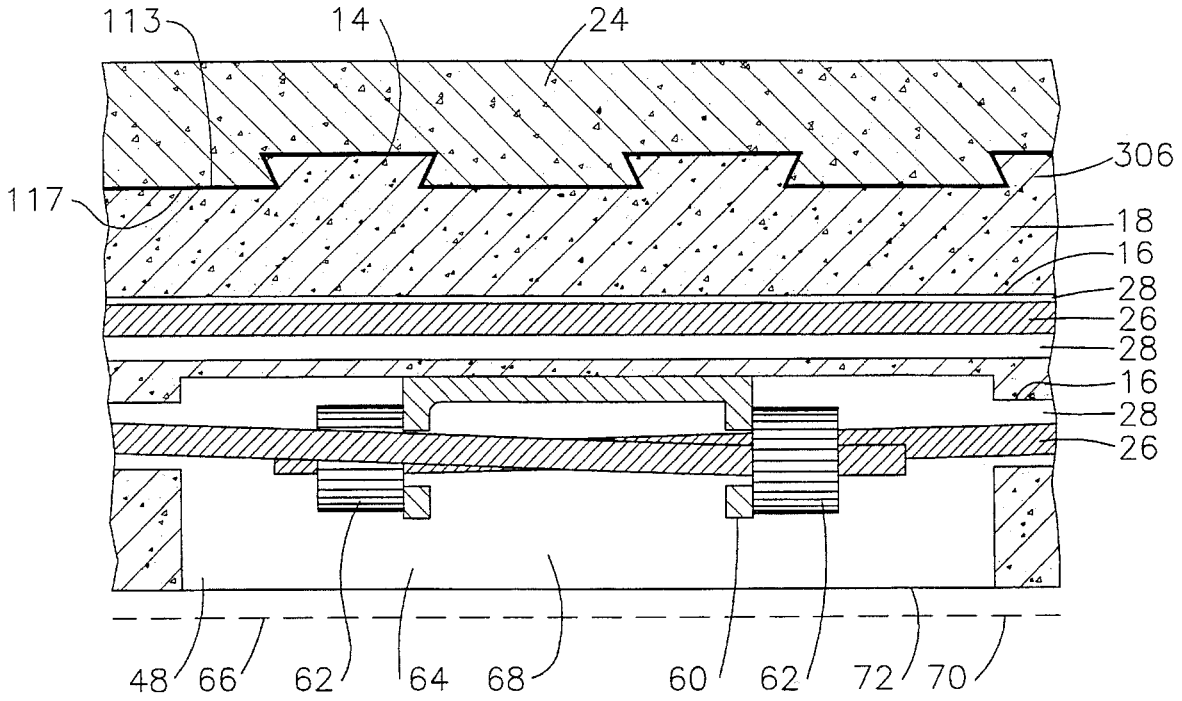
FIG. 20 is a horizontal cross-section view at the location of a stressing buttress in a generally oval tank of either elongate or elliptical configuration.

FIG. 20 reveals the buttress 60 which can be placed on any of the precast wall panels, such as panel 306. The location of the buttress 60 will vary depending on the size of the tank. On a tank of approximately fifty foot diameter I might use only one buttress 60, whereas on a tank of average dimensions of seventy feet, I would probably use two buttresses 60, typically located at opposite sides of the tank. In larger oval tanks I would consider using three or four buttresses 60 to most effectively utilize my stressing members 26 and to reduce the loss of stress in the tensioning member 26 due to friction between the tensioning member and the duct 16.

The multiple variations of the buttresses 60 which are previously described for the first embodiment are applicable to all embodiments of this invention.

Figure 19:
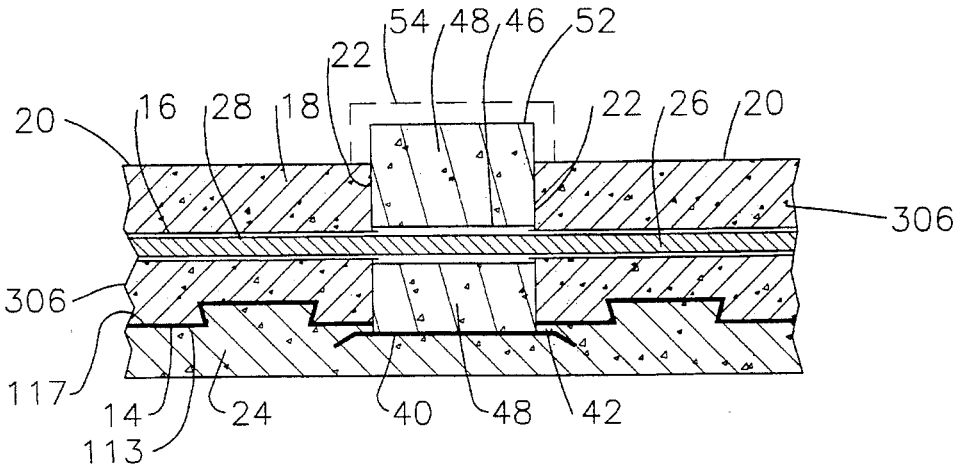
FIG. 19 is a horizontal cross section view of the connection between two precast wall panels of same or different curvature, with a decorative pilaster incorporated into the closure strip.

The previous discussion of FIG. 6 revolved around the architectural treatment that can be realized at the closure strip by creating a pilaster finished surface 52. The features of this apply directly to the second and third embodiments of this invention and are shown in FIG. 19. The pilaster finish surface 52 can be applied to both like and unlike panels that are joined together regardless of curvature.

Figure 21:
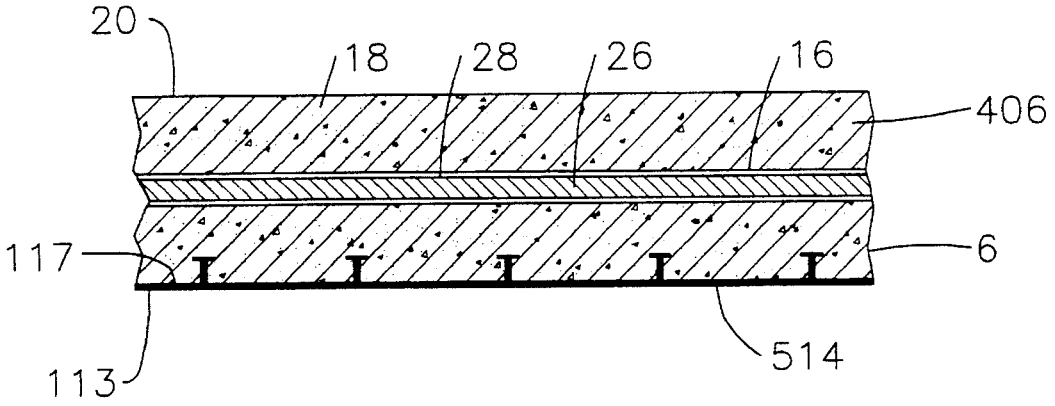
FIG. 21 is a section view of a typical precast wall panel of a generally oval tank in which a rubber type material is used for the diaphragm liner.

FIG. 21 shows a precast wall panel with a diaphragm liner 514 different from the corrugated metal material previously described, and in this particular instance, the diaphragm liner is composed of a normally resistant material. I prefer to use a rubber type material, that may for example be approximately ⅛" to ¼ thick. This material comes in sheets that can be unrolled and cut to length. Essentially parallel rib-like protrusions may be disposed upon three to six inch centers. The most preferred rubber like material is a pvc liner material such as is used in an environment pertaining to sewage disposal. I have selected a rubber type material made of pvc because it is virtually unaffected by the presence of acids or other chemical constituents of the tank, where in certain instances a stainless steel diaphragm liner may not be resistant. The rubber type material composing the diaphragm liner 514 has a first face 113 and a second face 117, much like the previously mentioned diaphragm liners.

Figure 22:
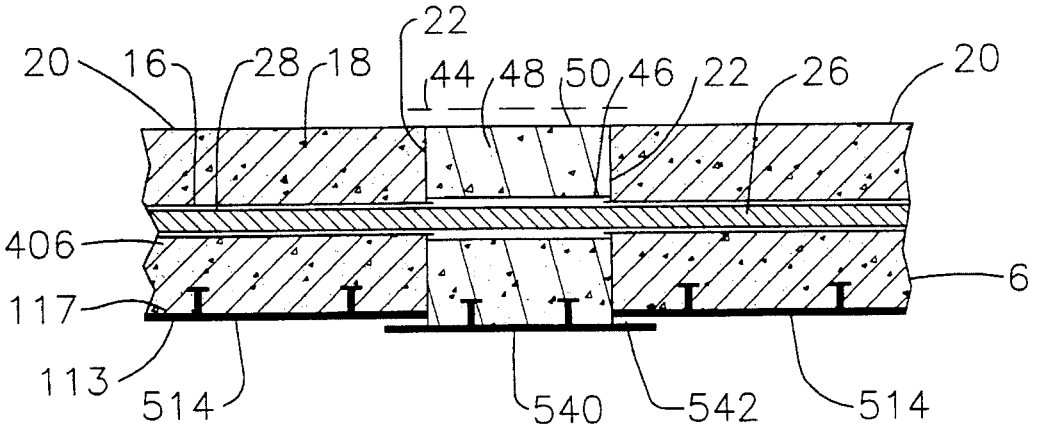
FIG. 22 is a horizontal cross section view similar to FIG. 21, with this view being taken at the intersection of two precast wall panels created by the use of rubber type material for the diaphragm liner.

The preferred rubber type material has a second face 117 with protrusions which penetrate into the concrete and make it an integral part of the wall. I prefer to use the ribs in the precast concrete panels in a manner such that they run vertical in the finished wall surface. Although the ribs could be placed so as to run horizontally, such is not preferred because from the structural standpoint, the tank wall in bending will have points of stress concentration in a horizontal direction which will tend to induce horizontal cracking of the tank when the tank is loaded hydraulically and the wall goes into a vertical bending. The rubber type material diaphragm liner 514 is preferably as wide as the precast wall panel. This will reduce the necessity for placing a vertical seam in the liner, which is expensive and subject to close scrutiny on quality control. The manner of making the diaphragm liner 514 continuous across the closure strip is shown in FIG. 22, with a rubber liner strip 540 being utilized in the closure strip. To make the diaphragm liner 514 continuous across the closure strip a sealant 542 must be used. The particular type sealing method I prefer is a thermal sealant of the liner strip 540 to the diaphragm liner 514.

This may be accomplished by heating the two materials and thermally fusing them. The method of heating that I prefer to use involves an industrial blower heater, which functions similar to hair dryer. This process of thermal sealing is known by those familiar with the trade.

As should now be apparent, I have described a novel method for creating a tank of generally oval configuration by the use of a plurality of precast concrete panels. In accordance with one procedure, a diaphragm liner of corrugated structural material of a generally rectangular configuration is utilized, which possesses a degree of arcuate curvature in one direction. Concrete is applied to the second face of such diaphragm liner in order that the corrugations are covered to a consistent depth, thus forming a panel suitable for tank construction. The surface of the concrete is thereafter contoured to a finished condition, so as to be suitable for the exterior of the tank to be formed out of the panels. After the individual panels are completed, a plurality of the panels are assembled into the configuration of a generally oval tank, with the abutting edges of the panels spaced closely together. Means are then utilized for securing the abutting edges of the panels tightly together, preferably by the use of a circumferentially extending steel stressing member, with concrete being poured over the abutting edges and then shaped so as to complete the tank construction.

The novel method in accordance with this invention may comprise the steps of creating a number of diaphragm liners of either corrugated structural material of a generally rectangular configuration, or else liners of rubber-like material. Each diaphragm liner is placed on a supporting surface of desired configuration, with the first face down and the second face up. Concrete is then poured to a desired depth on the second face of the diaphragm liner, such that the corrugations (if used) are covered. Reinforcing components such as the ducts to accommodate respective tensioning members are either added before the concrete is poured, or shortly thereafter. Before hardening of the concrete takes place, it is shaped to an essentially consistent thickness and thereafter the surface is treated to a finished condition, so as to be suitable for the exterior of the tank to be formed out of the panels.

After a suitable number of wall sections or panels have been created in this manner, these panels are assembled into a desired configuration of a generally oval tank, with the abutting edges of the tank secured together. The previously described tensioning member may be inserted through all of the horizontally aligned ducts, and made tight to secure the panels firmly together. Concrete is then poured between the abutting edges, and a cementitious coating is applied over the diaphragm liner.

As should now be clear, my novel method of constructing generally oval tanks has many advantages over the complicated and time-consuming procedures of the prior art.

It is obvious that the dimensions and materials mentioned herein are by way of illustration, and I am not to be limited except as required by the scope of the appended claims.

I claim:

1. A method of creating a tank of generally oval configuration by the use of a plurality of precast wall panels of a consistent configuration, comprising the steps of a. creating a diaphragm liner of generally rectangular configuration, possessing a first face and a second face, b. placing said diaphragm liner on a supporting surface with said first face down and said second face up, c. securing a plurality of elongate ducts in a spaced, parallel relationship at a location above said second face of said diaphragm liner, with the duct spacing being in accordance with a consistent pattern, d. pouring concrete to a desired depth on said second face of said diaphragm liner, such that said diaphragm liner as well as said ducts are covered to a consistent depth, e. before hardening takes place, shaping the concrete to an essentially consistent thickness, thus to create a generally rectangularly shaped wall panel suitable for tank construction, f. contouring the surface of the concrete to a finished condition, so as to be suitable for the exterior of the tank to be formed out of the panels, g. thereafter assembling the plurality of panels so formed into the configuration of a generally oval tank, with the abutting edges of the panels spaced closely together, and said ducts in substantial alignment, h. inserting a tensioning member through each set of substantially aligned ducts of the assembled panels, i. pouring concrete between the abutting edges and then shaping the concrete to a finished condition, and j. applying tension to each tensioning member so as to draw the abutting edges of said panels tightly together.

2. The method of creating a tank as recited in claim 1 in which each of said generally rectangularly shaped wall panels is formed in a configuration of consistent curvature, such that a circular tank will be formed when said panels are assembled together into a completed tank.

3. The method of creating a tank as recited in claim 2 in which a cementitious coating is applied over said first face of the diaphragm liner.

4. The method of creating a tank as recited in claim 2 in which a diaphragm liner of corrugated material is utilized in the construction of each panel.

5. The method of creating a tank as recited in claim 2 in which a diaphragm liner of rubber type material is utilized in the construction of each panel.

6. The method of creating a tank as recited in claim 1 in which the generally rectangularly shaped precast wall panels are of two different configurations in order to create a tank of generally elongate configuration, with a plurality of substantially flat panels utilized along each side of such tank, and panels of substantial curvature utilized at each end of such tank.

7. The method of creating a tank as recited in claim 6 in which a cementitious coating is applied over said first face of each diaphragm liner after the tank is assembled.

8. The method of creating a tank as recited in claim 6 in which a diaphragm liner of corrugated material is utilized in the construction of each panel.

9. The method of creating a tank as recited in claim 6 in which a diaphragm liner of rubber type material is utilized in the construction of each panel.

10. The method of creating a tank as recited in claim 1 in which the generally rectangularly shaped precast wall panels are of two different configurations in order to create a tank of generally elliptical configuration, with a plurality of panels of slight curvature being utilized along each side of such tank, and panels of substantial curvature utilized at each end of such tank.

11. The method of creating a tank as recited in claim 10 in which a cementitious coating is applied over said first face of each diaphragm liner after the tank is assembled.

12. The method of creating a tank as recited in claim 10 in which a diaphragm liner of corrugated material is utilized in the construction of each panel.

13. The method of creating a tank as recited in claim 10 in which a diaphragm liner of rubber type material is utilized in the construction of each panel.

14. A tank of generally oval configuration having a wall created by a plurality of abutting precast wall panels, each said precast wall panel being of consistent preselected configuration utilizing a diaphragm liner, the diaphragm liner of each panel being of a generally rectangular configuration and uniform thickness, each diaphragm liner possessing a first face and a second face, a plurality of elongate ducts disposed in a spaced, essentially parallel relationship at locations adjacent to the second face of each said diaphragm liner, with the duct spacing being in accordance with a consistent pattern, concrete being utilized on a said second face of each diaphragm liner, such that the diaphragm liner as well as said ducts are covered by concrete to a substantially consistent depth, the concrete being shaped to an essentially consistent thickness and the surface of the concrete contoured to a finished condition, suitable for the exterior of the tank, said precast wall panels grouped into a tank wall of generally oval configuration, with the abutting edges of the panels spaced closely together, and all of said ducts in generally horizontal alignment, a horizontally disposed tensioning member extending through corresponding ducts of the several panels, and concrete utilized over the abutting edges and contoured to a finished condition, said tensioning members being secured in a tensioned condition to hold said panels tightly together.

15. The tank of generally oval configuration utilizing a plurality of panels as recited in claim 14 in which each of said panels is of consistent curvature, such that said panels together form a circularly shaped tank.

16. The tank of generally circular configuration as recited in claim 15 in which the first face of each said diaphragm liner has a cementitious coating.

17. The tank of circular shape as recited in claim 15 in which each diaphragm liner is made of corrugated material.

18. The tank of circular shape as recited in claim 15 in which each diaphragm liner is made of rubber type material.

19. The tank of generally oval configuration as recited in claim 14 in which said tank has substantially flat sides and curved ends, said precast wall panels being of two different configurations, with panels of a first configuration having substantial curvature and panels of a second configuration being substantially flat and used on the substantially flat sides of the tank, thus to form an elongate tank.

20. A tank of generally oval configuration as recited in claim 19 in which the first face of each said diaphragm liner has a cementitious coating.

21. The tank of generally oval configuration as recited in claim 19 in which said diaphragm liner is made of corrugated material.

22. The tank of generally oval configuration as recited in claim 19 in which said diaphragm liner is made of rubber type material.

23. The tank of generally oval configuration utilizing a plurality of precast wall panels as recited in claim 14 in which said precast wall panels are of two different configurations, with precast wall panels of a first configuration being substantially curved and being used at the ends of the tank, and precast wall panels of a second configuration being slightly curved and being used in the section of the tank wall located between the ends of the tank, thus to form an elliptically shaped tank.

24. The tank of elliptical configuration as recited in claim 23 in which the first face of each diaphragm liner has a cementitious coating.

25. The tank of elliptical configuration as recited in claim 23 in which said diaphragm liner is made of corrugated material.

26. The tank of elliptical configuration as recited in claim 23 in which said diaphragm liner is made of rubber type material.

27. A tank of generally circular configuration in having a wall created by a plurality of abutting precast wall panels, each said precast wall panel being of consistent curvature and configuration and utilizing a diaphragm liner of generally rectangular configuration, each diaphragm liner possessing a selected degree of arcuate curvature in one direction, thus being concave on one side and convex on the other side, a plurality of elongate ducts disposed in a spaced, parallel relationship at locations adjacent the convex surface of each said diaphragm liner, with the duct spacing being in accordance with a consistent pattern, concrete being utilized on said convex surface of each diaphragm liner, such that the diaphragm liner as well as said ducts are covered by concrete to a consistent depth, the concrete being shaped to an essentially consistent thickness to create a wall panel, with the surface of the concrete contoured to a finished condition, suitable for the exterior of the tank, said precast wall panels grouped into a circularly shaped tank wall, with the abutting edges of the panels spaced closely together, and all of said ducts in circumferential alignment, a circumferential tensioning member extending through corresponding ducts of the several panels, and concrete utilized over the abutting edges and contoured to a finished condition, said tensioning members being tensioned to hold said panels tightly together.

28. The tank of generally circular configuration as recited in claim 27 in which the concave side of each of said diaphragm liners has a cementitious coating.

29. The tank of generally circular configuration as recited in claim 27 in which each of said diaphragm liners is made of corrugated material.

30. The tank of generally circular configuration as recited in claim 27 in which each of said diaphragm liners is of rubber type material.

* * * * *